US010899512B2

(12) United States Patent
Lane

(10) Patent No.: US 10,899,512 B2
(45) Date of Patent: Jan. 26, 2021

(54) FOOD JAR

(71) Applicant: THERMOS L.L.C., Schaumburg, IL (US)

(72) Inventor: Marvin Lane, Wheeling, IL (US)

(73) Assignee: Thermos L.L.C., Schaumburg, IL (US)

( * ) Notice: Subject to any disclaimer, the term of this patent is extended or adjusted under 35 U.S.C. 154(b) by 130 days.

(21) Appl. No.: 15/935,346

(22) Filed: Mar. 26, 2018

(65) Prior Publication Data

US 2018/0273259 A1 Sep. 27, 2018

Related U.S. Application Data

(60) Provisional application No. 62/581,350, filed on Nov. 3, 2017, provisional application No. 62/477,300, filed on Mar. 27, 2017.

(51) Int. Cl.
*B65D 51/16* (2006.01)
*B65D 23/10* (2006.01)
(Continued)

(52) U.S. Cl.
CPC ..... *B65D 51/1688* (2013.01); *B65D 23/104* (2013.01); *B65D 23/108* (2013.01); *B65D 43/0229* (2013.01); *B65D 43/0231* (2013.01); *B65D 51/1644* (2013.01); *B65D 77/0486* (2013.01); *B65D 2251/005* (2013.01);
(Continued)

(58) Field of Classification Search
CPC ..... B65D 51/1688; B65D 43/0229; B65D 77/0486; B65D 23/108; B65D 23/104; B65D 51/1644; B65D 43/0231; B65D 2251/0081; B65D 2251/0018; B65D 2251/005; B65D 2543/00231; B65D 2543/00092; B65D 41/28; B65D 51/1683; B65D 53/02
USPC ..... 220/259.3, 259.4, 367.1, 521, 523, 220/203.28, 304; 215/307, 314, 354
See application file for complete search history.

(56) References Cited

U.S. PATENT DOCUMENTS 2,819,812 A * 1/1958 Freundorfer ..... B65D 47/00 220/259.4
3,378,168 A * 4/1968 Hildebrandt ..... B65D 51/2814 222/83
(Continued)

FOREIGN PATENT DOCUMENTS

CN 203581583 U 5/2014
CN 203727916 U 7/2014
WO 2016/001104 A1 1/2016

OTHER PUBLICATIONS

Taiwan Patent Application No. 107110566 Office Action dated Feb. 19, 2019 (with English translation); (11 pages).
(Continued)

*Primary Examiner* — James N Smalley
(74) *Attorney, Agent, or Firm* — Polsinelli PC

(57) ABSTRACT

A food jar is described that may be used to store and transport food items. The food jar includes a container, a lid, and a vent. As the lid is unscrewed from the container, the vent opens to equilibrate air pressure within the container with the atmosphere. The vent relieves high and low pressure within the container. The food jar may also include stopper with a vent. The stopper may include an upper and a lower stopper that form the vent.

20 Claims, 23 Drawing Sheets

(51) Int. Cl.
*B65D 43/02* (2006.01)
*B65D 77/04* (2006.01)

(52) U.S. Cl.
CPC ..... *B65D 2251/0018* (2013.01); *B65D 2251/0081* (2013.01); *B65D 2543/00092* (2013.01); *B65D 2543/00231* (2013.01)

(56) References Cited

U.S. PATENT DOCUMENTS

| | | | | | |
|---|---|---|---|---|---|
| 3,708,083 | A * | 1/1973 | Gronemeyer | B65D 51/1644 | 215/213 |
| 4,133,462 | A * | 1/1979 | Lindstrom | B65D 47/128 | 215/214 |
| 4,340,138 | A * | 7/1982 | Bernhardt | B65D 51/18 | 206/216 |
| 5,108,001 | A * | 4/1992 | Harris | B60K 15/0406 | 220/203.06 |
| 8,998,014 | B2 * | 4/2015 | Iwasaki | A45C 11/20 | 220/254.1 |
| 2006/0096985 | A1 * | 5/2006 | Stolzman | B65D 51/1644 | 220/276 |
| 2008/0217335 | A1 | 9/2008 | Chen | | |
| 2010/0252583 | A1 * | 10/2010 | Maas | B65D 83/0055 | 222/386.5 |
| 2012/0074143 | A1 * | 3/2012 | Lin | A47J 31/18 | 220/259.4 |

OTHER PUBLICATIONS

Chinese Patent Application No. 201810257990.5 Office Action dated Aug. 30, 2019 with translation (16 pages).
Chinese Patent Application No. 20181027990.5 Office Action dated Mar. 11, 2019 with translation (9 pages).

* cited by examiner

FOOD JAR

CROSS REFERENCE TO RELATED APPLICATIONS

This application claims the benefit of U.S. Provisional Patent Application 62/581,350 filed Nov. 3, 2017 and the benefit of U.S. Provisional Patent Application 62/477,300 filed Mar. 27, 2017, which are both hereby incorporated by reference.

FIELD OF INVENTION

The present invention relates to a food jar with a vent.

BACKGROUND

Food containers are often used to store and transport food items. Conventional food containers have several disadvantages. A first disadvantage is caused by vacuum formation within the food container. For example, if a hot food is allowed to cool in the food container and form a low pressure in the food container, then a vacuum may form in the food container. The vacuum may make a lid or other closing structure of the conventional food container difficult to remove.

Another disadvantage is caused by high pressures formed within the food containers. For example, certain food items will increase pressure in the container if the container and the food item are agitated. Also, for example, after prolonged storage of food items in the container, certain food items will release gases into the container that will increase pressure in the container. These high pressures may lead to inadvertent food spray or food release when the container is opened.

SUMMARY

A food jar is described that may be used to store and transport food items or drink items. The food jar includes an insulated or uninsulated structure to store the food items, possibly at warmed or chilled temperatures for later consumption.

The illustrated embodiment of a food jar includes a container, a stopper, and a lid. The container includes an interior to store a food item or could be configured to store beverage items. The stopper closes an opening of the container. The food jar further includes a vent. As the lid is unscrewed from the container, the vent opens to equilibrates air pressure within the container with the atmosphere. The vent provides for gas to pass through the stopper in both an incoming and an outgoing direction from the container in order to reach equilibrium. The vent relieves pressure within the container before the lid is completely removed. The vent is opened with only a partial unscrewing of the lid. Since the lid does not need to be completely removed for the vent to be opened, this release of pressure helps to minimize the likelihood of a lid coming off forcefully or at least minimizes the force upon the lid release.

The vent is useful in both high and low pressure situations. For example, if a hot food item is allowed to cool in the food jar and a vacuum forms, then partially unscrewing the lid will open the vent and release the vacuum. For example, if a high pressure is formed in the container from agitation or prolonged storage of food items, then partially unscrewing the lid will releases the high pressure in a controlled manner with minimal spray or release of the food product.

As the lid is engaged to the container, the vent is automatically closed. As the lid is removed from the container, the vent is automatically opened.

In one aspect, the stopper is held to the opening of the container by the lid. The lid screws onto the container causing the stopper to seal against the opening of the container. The stopper includes or forms a vent passage. The lid includes a closing member, such as a peg, descending member, stopper, plug, extension, etc, positioned on the lid that inserts into, seals, blocks, or otherwise closes the vent passage of the stopper. This action open and closes the vent, passage as the lid is screwed or unscrewed from the container.

In other aspects, the stopper may screw directly to the opening of the container or to other structures of the container. The stopper and the container may include complementary threaded surfaces for engaging the stopper to the container.

In another aspect, a food jar includes a container, a stopper, and a lid. The container defines an interior to store a food product. The container has an opening. The stopper is sized to close the opening of the container. The stopper has a vent passage passing through the stopper. The vent passage has a first opening and a second opening. The food jar includes the lid having a lower lid surface. The lower lid surface has a closing member positioned to insert into the first opening of the vent passage.

In another aspect, a food jar includes a container, a stopper, and a lid. The container defines an interior to store a food product. The container has an opening. The container has a neck with a threaded external surface. The stopper is sized to close the opening of the container. The stopper has a vent passage passing through the stopper. The vent passage has a first opening at an upper surface of the stopper and a second opening at a bottom surface of the stopper. The lid has a lower lid surface. The lower lid surface has a peg positioned to insert into the first opening of stopper. The lid has a threaded surface to threadably engage with the threaded external surface of the container neck.

In another aspect, a food jar includes a container. The container defines an interior to store a food product. The container has an opening. The container has a neck with a threaded external surface. The food jar includes a stopper. The stopper is sized to close the opening of the container. The stopper has a vent passage passing through the stopper. The vent passage has a first opening at an upper surface of the stopper and a second opening at a bottom surface of the stopper. A stopper gasket is positioned at or in the first opening of the stopper. The stopper gasket including a gasket opening. A seal is positioned between an interior surface of the container and an exterior surface of the stopper to seal the interior of the container. The food jar includes a lid. The lid has a lower lid surface. The lower lid surface has a peg positioned to insert into the gasket opening. The lower lid surface has an extending member to press against the upper surface of the stopper. The lid has a threaded interior surface to threadably engage with the threaded external surface of the container neck. Threadably engaging the threaded interior surface of the lid and the threaded external surface of the container neck in a locking direction inserts the peg into the gasket opening and closes the vent passage. Threadably engaging the threaded interior surface of the lid and the threaded external surface of the container neck in an unlocking direction withdraws the peg from the gasket opening and opens the vent passage.

In another aspect, a food jar includes a stopper with an automatic pressure relief function. The stopper provides an automatic release of pressure without having to unscrew the stopper or otherwise move the stopper. When pressure is very low or very high in the container, a vent of the stopper may open to release gas from within the container or to admit ambient air into the container.

In another aspect, a gasket with a gasket opening and a flap is positioned at or in a vent passage of a stopper. The gasket allows the vent passage to open under both high and low pressures. A closing member enters the gasket opening. The flap urges against the closing member to close the vent passage. When there is high pressure in the container, the flap may move or deflect in one direction from the closing member to release gas from the container. When there is low pressure in the container, the flap may move or deflect from the closing member in another direction to admit ambient air into the container.

In another aspect, a food jar includes a container. The container defines an interior to store a food product. The container has an opening. The food jar includes an upper stopper, and a lower surface of the upper stopper has a closing member. The food jar includes a lower stopper. The lower stopper closes the opening of the container. The lower stopper includes a vent passage. The lower stopper includes a gasket positioned at or in the vent passage. The gasket includes a gasket opening and a flap. The lower stopper receives the upper stopper into an interior of the lower stopper such that the closing member of the upper stopper inserts into the gasket opening of the lower stopper and the flap contacts the closing member to close the vent passage when the upper stopper and the lower stopper are in a generally closed position. The flap is movable in one direction to release gas from the container, and the flap is movable in another direction to admit ambient air into the container.

DETAILED DESCRIPTION OF INVENTION

Figure 1:
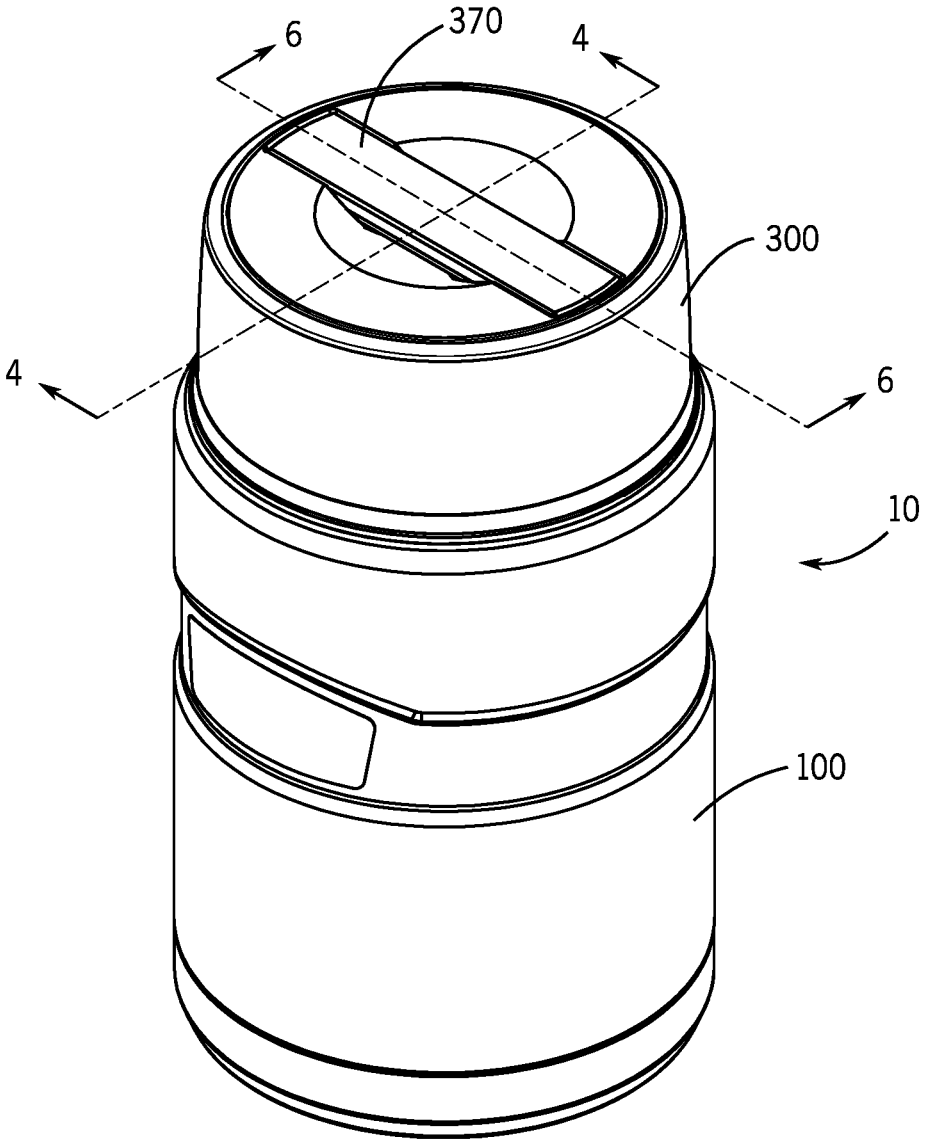
FIG. 1 is a perspective view of an embodiment of a first food jar with a first stopper.

For purposes of this application, any terms that describe relative position (e.g., “upper”, “middle”, “lower”, “outer”, “inner”, “above”, “below”, “bottom”, “top”, etc.) refer to an embodiment of the invention as illustrated, but those terms do not limit the orientation in which the embodiments can be used. A food jar 10 will now be described with references to FIGS. 1-10. The food jar 10 includes a container 100, a stopper 200, and a lid 300.

The container 100 includes a wide mouth opening 102 to readily accept food items such as stews, chili, soups, beverages, or other foods that might not fit so easily into a narrow mouth container. The container 100 may be vacuum insulated or insulated with an insulating material. The opening 102 leads into an interior 104 of the container 100 that holds the food items.

The container 100 includes a neck 110 with a threaded exterior surface 112. The lid 300 includes a threaded internal surface 312. The lid 300 is engaged to the container 100 by threadably engaging the threaded internal surface 312 of the lid 300 with the threaded exterior surface 112 of the neck 110. The neck 110 further includes an internal surface 114.

Figure 4:
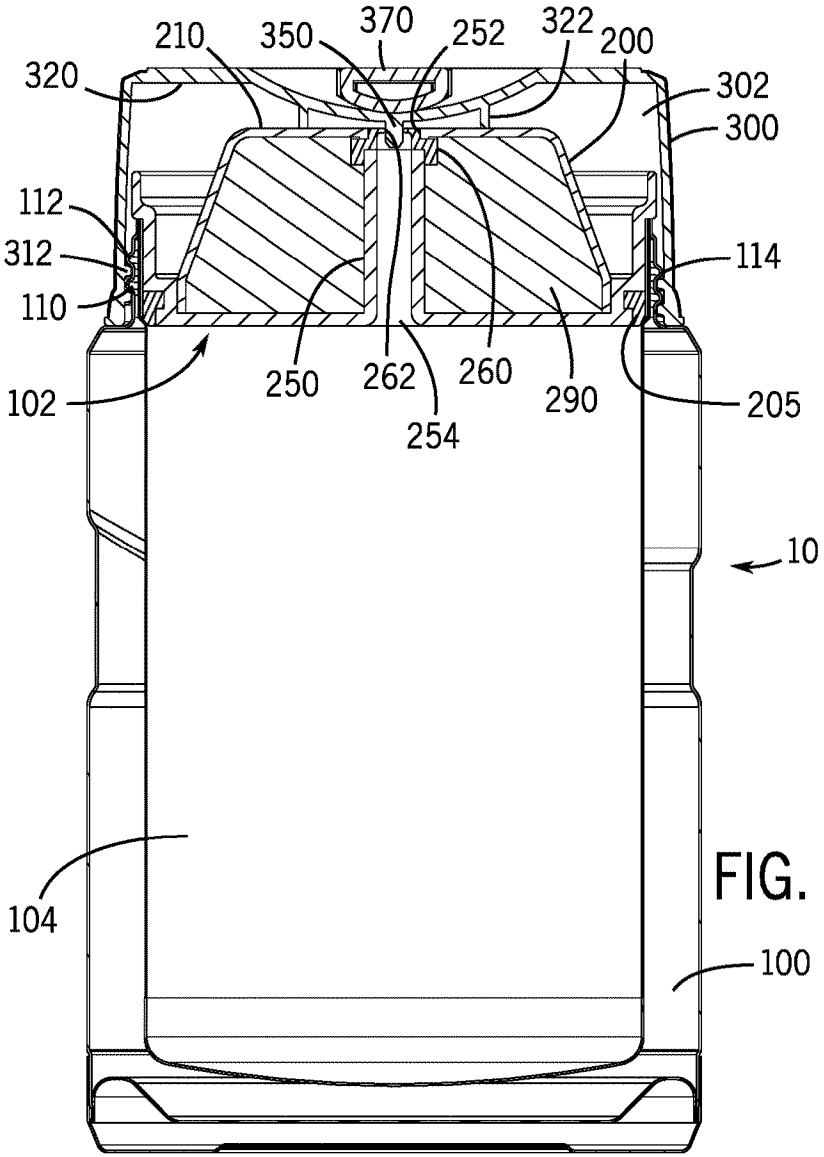
FIG. 4 is a sectional view of an embodiment of the first food jar with the vent passage in a closed position.
Figure 7:
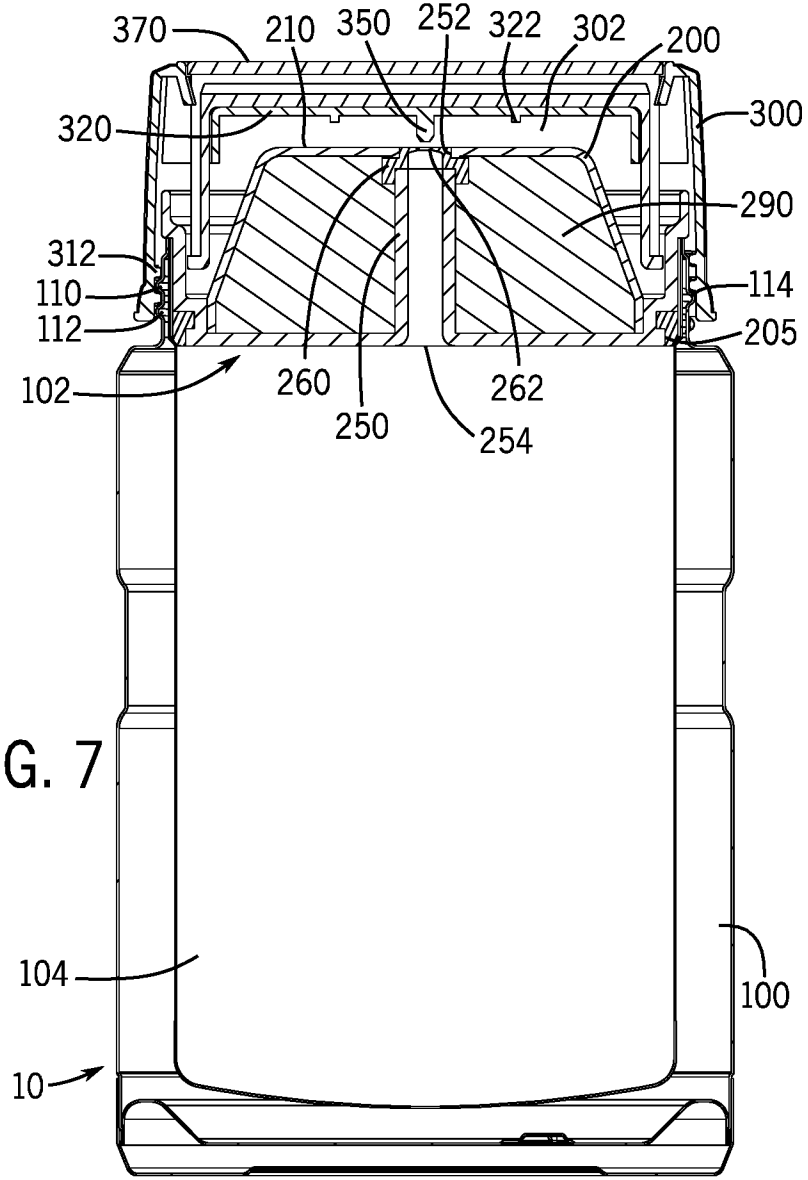
FIG. 7 is a sectional view of an embodiment of the first food jar with the vent passage in an open position.
Figure 6:
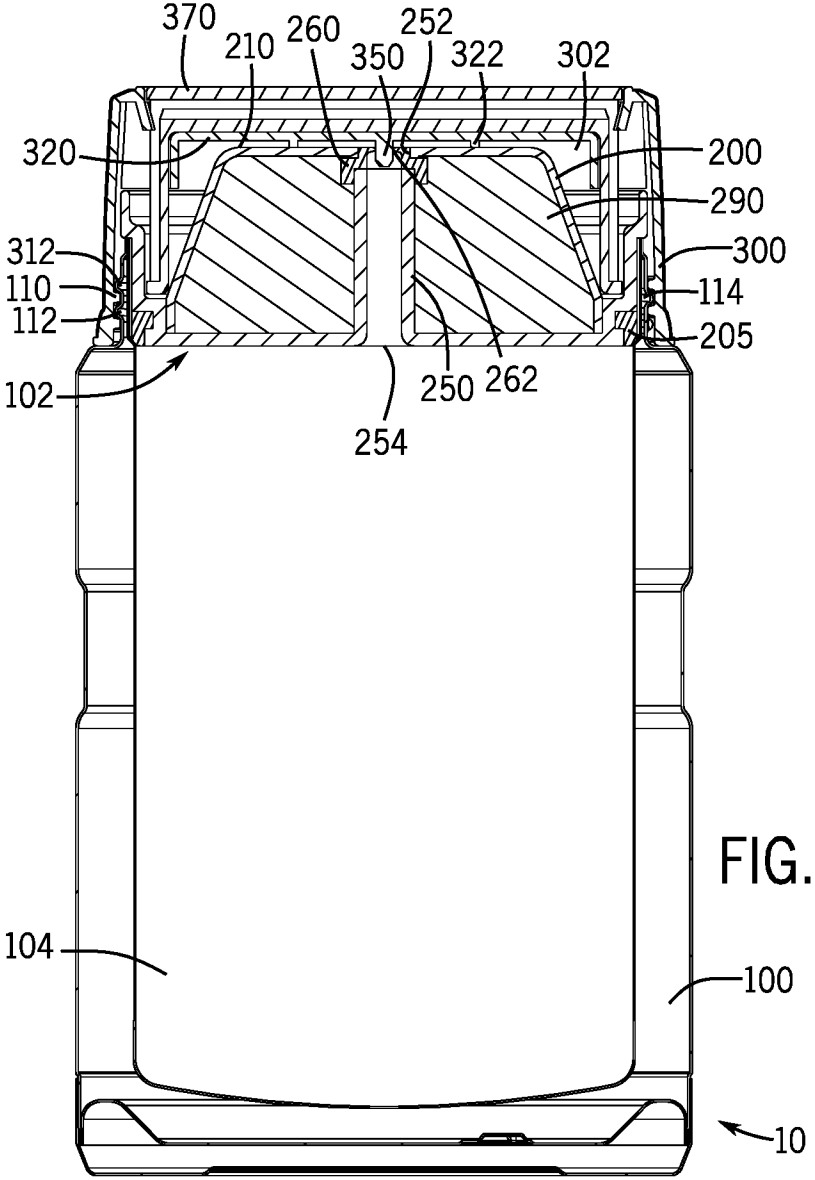
FIG. 6 is a sectional view of an embodiment of the first food jar with the vent passage in a closed position.

As the lid 300 is threadably engaged to the container 100, an inner, lower surface of the lid 300 urges or presses against the stopper 200 to urge or press the stopper 200 into the opening 102 of the container 100 and against the internal surface 114 of the neck 110. The stopper 200 seals the container 100 to a closed position. The stopper 200 includes a seal 205 to seal against the internal surface 114 of the neck 110 of the container 100. As shown in FIG. 4, a lower lid surface 320 of the lid 300 includes an extending member 322 that urges or presses against an upper surface 210 of the stopper 200. As the lid 300 screwed to the container 100, the extending member 322 pushes against the upper surface 210 of the stopper 200 to seal the stopper 200 and its seal 205 to the internal surface 114 of the neck 110.

The lid 300 may include a two-part construction having an inner lid member 310 and an outer lid member 325. In other aspects, the lid 300 may be formed from a single member.

The stopper 200 includes a vent passage 250 that provides for gas to pass through the stopper 200. The lower lid surface 320 further includes a peg 350 or other closing member that interacts with the vent passage 250 of the stopper 200. The peg 350 is on the underside of the lid 300. The peg 350 is inserted into a first opening 252 of the vent passage 200 as the lid 300 is screwed onto the container 100, which closes the vent passage 250. The peg 350 is removed from the first opening 252 of the vent passage 200 as the lid 300 is unscrewed from the container 100 to open the vent passage 250. This allows interior pressure within the container 100 to equalize with ambient pressure.

The vent passage 250 includes the first opening 252 communicating with interior space 302 inside of the lid 300 and a second opening 254 communicating with the interior 104 of the container 100. The first opening 252 may be at or in an upper surface 210 of the stopper 200, and the second opening 254 may be at or in a bottom surface 280 of the stopper 200. The vent passage 250 extends a width of the stopper 200, i.e., from the upper surface 210 to the bottom surface 280 and through an interior 290 of the stopper 200. The interior 290 of the stopper 200 may include insulation around the vent passage 250. The vent passage 250 may include a cylindrical member passing through the interior 290 of the stopper 200.

The stopper 200 includes a gasket 260 is positioned proximate the first opening 252. The gasket 260 is at or in the first opening 252 and includes a gasket opening 262 to receive the peg 350. The gasket 260 is made of resiliently flexible material that seals against the peg 250. The gasket 260 may define or line the first opening 252 of the vent passage 250.

In certain aspects, the stopper 200 includes an upper section 220 and a lower section 230 that contain insulation 240. In other aspects, the stopper 200 may include a one-piece construction. The vent passage 250 may be integrally molded to the lower section 230. The lower section 230 may form the second opening 254 of the stopper 200. The upper section 220 may form the first opening 252 of the stopper 200.

The first opening 252 of the vent passage communicates with the interior space 302 inside of the lid 300. As the lid 300 is unscrewed in a low pressure situation within the container 110, ambient air external to the food jar 10 may pass between the threaded internal surface 312 of the lid 300 and the threaded exterior surface 112 of the neck 110 and into the interior space 302 of the lid 300 in order to relieve the low pressure. This air may pass through the vent passage 250 and into the interior 104 of the container 100. In a high pressure situation within the container 100, air or gas in the interior 104 may exit the container 100 through the vent passage 250, into the interior space 302, and out of the food jar 10 via the threaded internal surface 312 of the lid 300 and the threaded exterior surface 112 of the neck 110.

Figure 2:
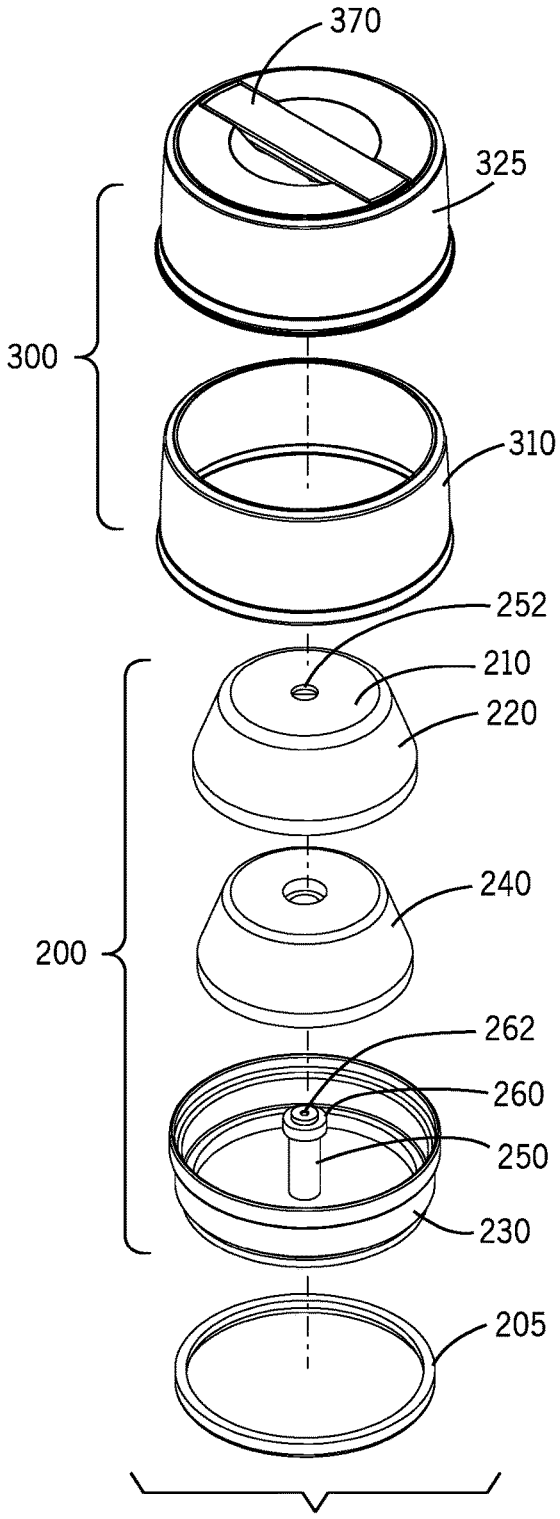
FIG. 2 is an exploded view of an embodiment of the first food jar.
Figure 3:
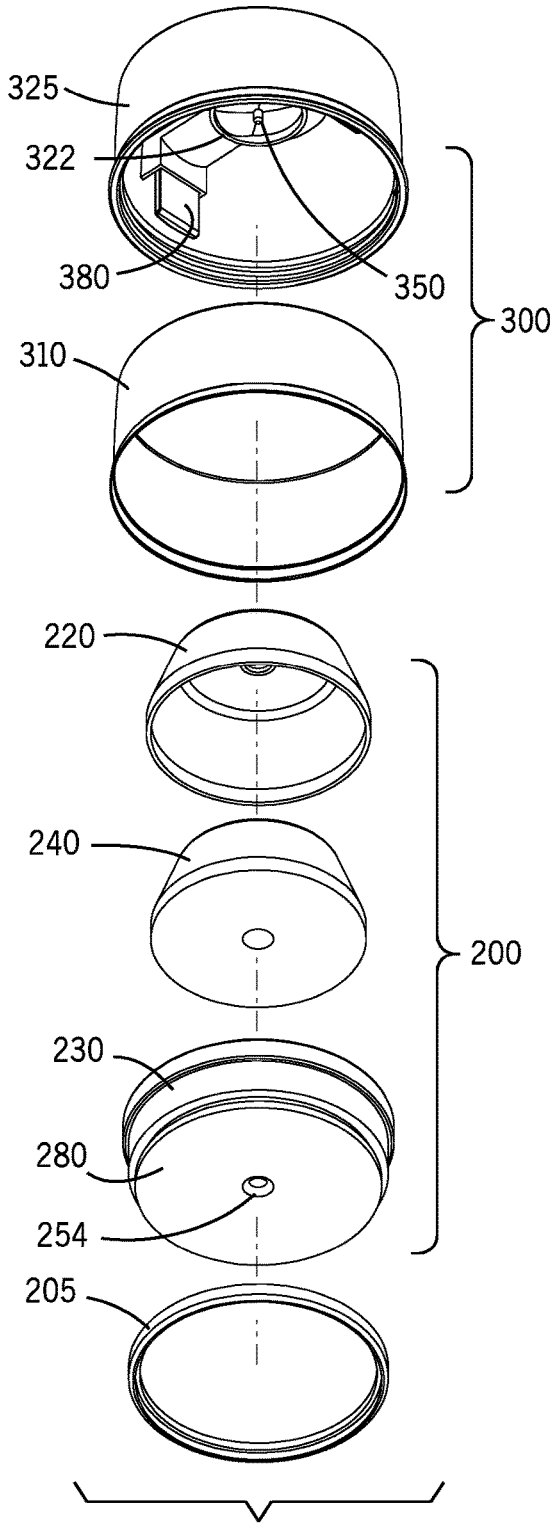
FIG. 3 is an exploded view of an embodiment of the first food jar.
Figure 5:
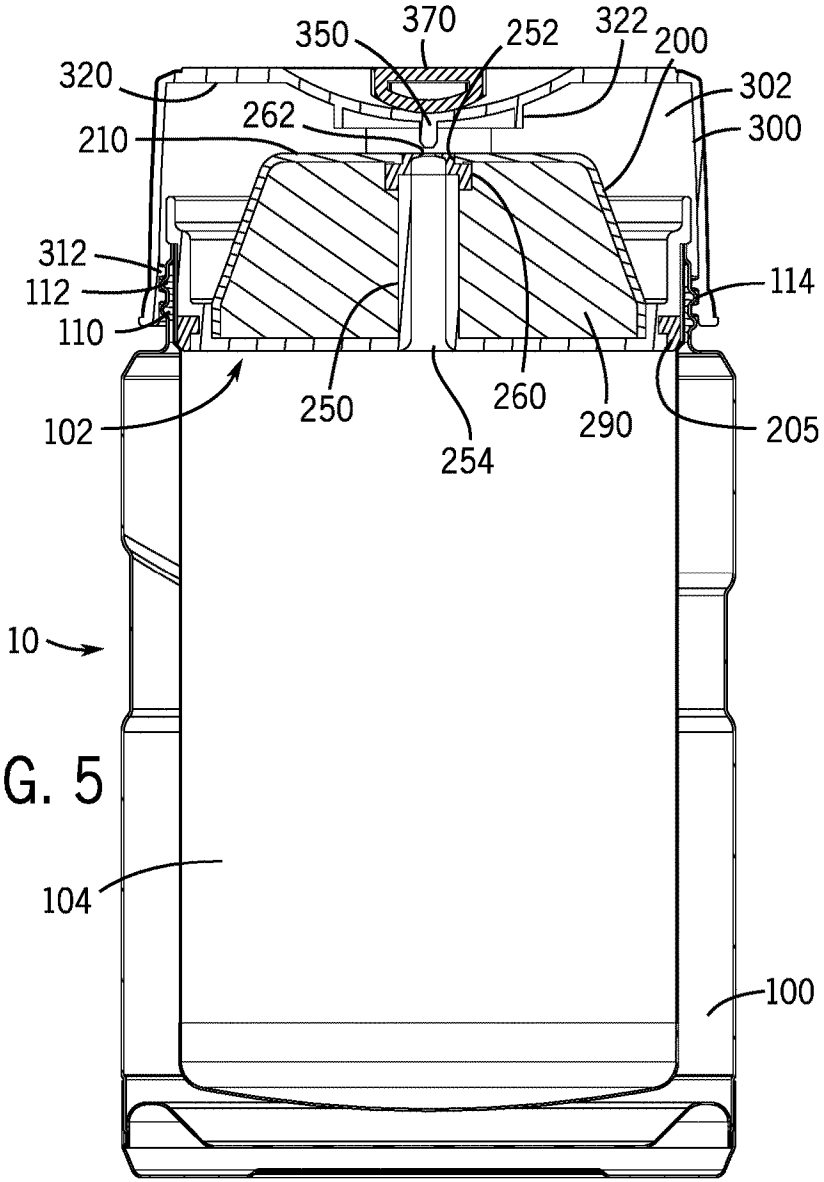
FIG. 5 is a sectional view of an embodiment of the first food jar with the vent passage in an open position.

With respect to FIG. 2, the lower lid surface 320 of the lid 300 is shown. The peg 350 extends from the lower lid surface 320 a greater distance than the member 322. This provides for the peg 350 to enter the gasket opening 262 and close the vent passage 250 as the lid 300 is screwed to the container 100. As the lid 300 is screwed to the container 100, the peg 350 moves closes to the gasket opening 262, and, as the lid 300 is further screwed to the container 100, the peg 350 enters or inserts into the gasket opening 262 and the member 322 presses against the upper surface 210 of the stopper 200. When the threaded surfaces are fully tightened, the peg 250 is fully inserted into the gasket opening 262 and closes the vent passage 250.

The peg 350 may be centrally located on the lower lid surface 320. A central axis of the peg 350 is aligned with a central axis of the vent passage 250. The lower lid surface 320 may include a convex surface 325 that positions the peg 250 closer to the gasket opening 262. The peg 350 may extend from the convex surface 325. The member 322 may include a circular shape that presses against the upper surface 210 of the stopper 200. The peg 350 may be positioned in a center of the circular-shaped member 322.

The vent passage 250 of the food jar 10 releases pressure from within the container 100 before the lid 300 is fully twisted off. When the lid 300 is at least partially unscrewed, the vent passage 250 is opened to vent the interior of the container 100 in a controlled manner. This is advantageous since there is a possibility that pressure may build up in the interior of the container 100 if the container 100 has been agitated or the food has been stored in the container 100 too long. The partial unscrewing of the lid 300 may open the vent passage 250 of the food jar 10 to releases a vacuum that may form within the container 100 if the food item has cooled in the food jar 10. This provides for easier removal of the lid 300. The vent passage 250 is able to relieve pressure within the container without totally removing the lid 300, which helps reduce inadvertent food spray when the high pressure within the container 100 is relieved.

The peg 350 includes other closing members, descending members, plugs, stoppers, extensions, etc. positioned or formed on the lid 300 or other first closing member that inserts into, seals, blocks, or otherwise closes a vent on the stopper 200 or second closing member. The screwing of the lid 300 to the container 100 aligns the closing member with the first opening 252 and the gasket opening 262 of the vent passage 250.

In certain aspects, the lid 300 and its peg 350 are completely removable or completely separable from the container 100 and the stopper 200.

Figure 8:
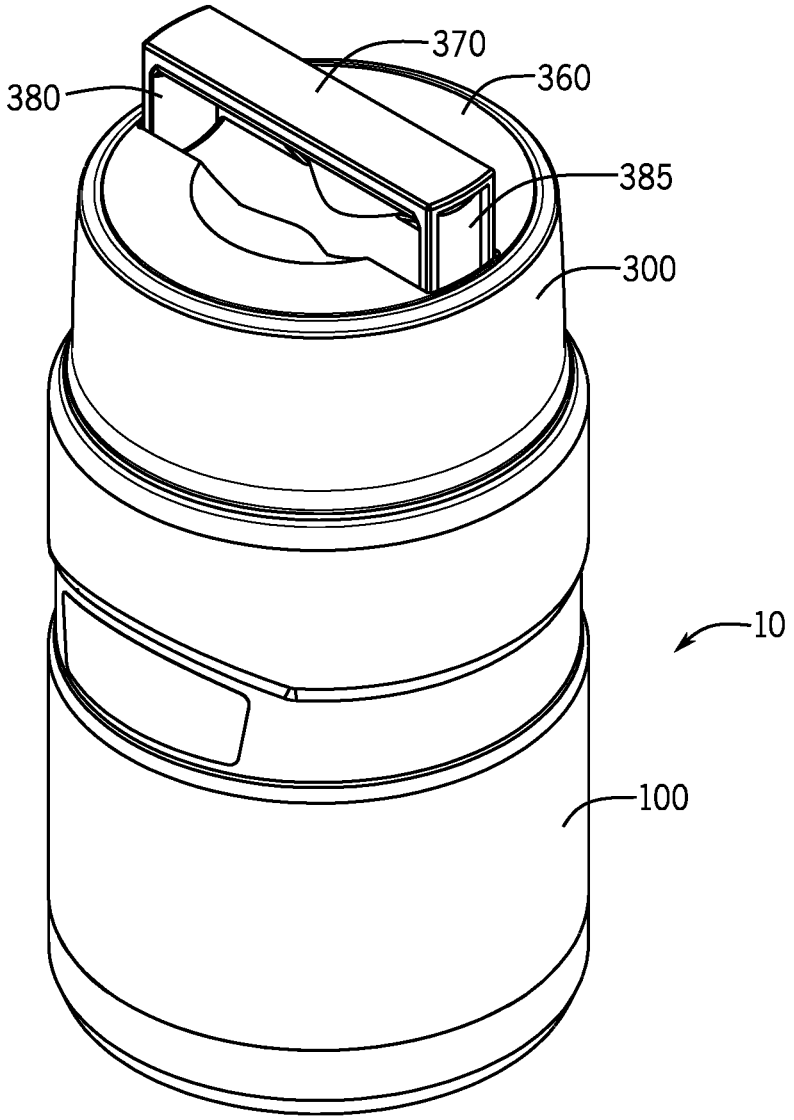
FIG. 8 is a perspective view of an embodiment of the first food jar with the handle extended.

With respect to FIG. 8, a top surface 360 of the lid 300 may include a retractable handle 370. The retractable handle 370 provides a convenient gripping structure for turning the lid 300 to open or close the lid 300. In other aspects, the lid 300 may omit the handle 370 or include a fixed handle or other carrying structure, such as a carrying loop. The retractable handle 370 retracts into the top surface 360 to be flush against the top surface 360. As the container 100 may configured, in certain aspects, to contain several liters of the food item, the retractable handle 370 provides assistance to the user in carrying the loaded food jar 10, which may weigh up to 5 pounds or more, when fully loaded with the food item. The retractable handle 370 is mounted to posts 380 and 385, which may be positioned on opposite sides of the retractable handle 370. The posts 380 and 385 are received into the lid 300, when the retractable handle 370 is in a retracted position, In other aspects, lid 300 may include multiple pegs 350 or other closing members that engage with multiple vents or vent passages 250.

In other aspects, the peg 350 is integrated to the retractable handle 370. Lifting or pulling upward on the handle 370 causes the peg 350 to withdraw from the vent passage 250, thus opening the vent passage 250. In such aspects, the vent passage 250 may be positioned in the lid 300 or in a stopper 200. Pushing downward on the handle 370 causes the peg 350 to insert into the vent passage 250, thus closing the vent passage 250.

Figure 9:
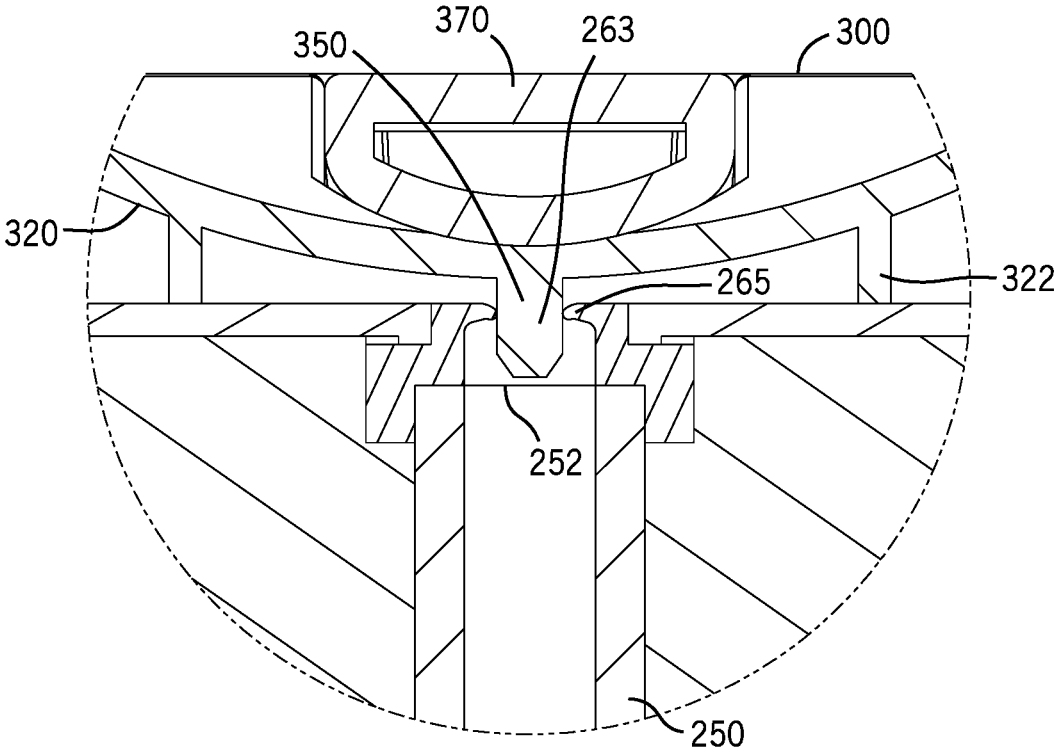
FIG. 9 is a close-up sectional view of another embodiment of the first food jar.
Figure 10:
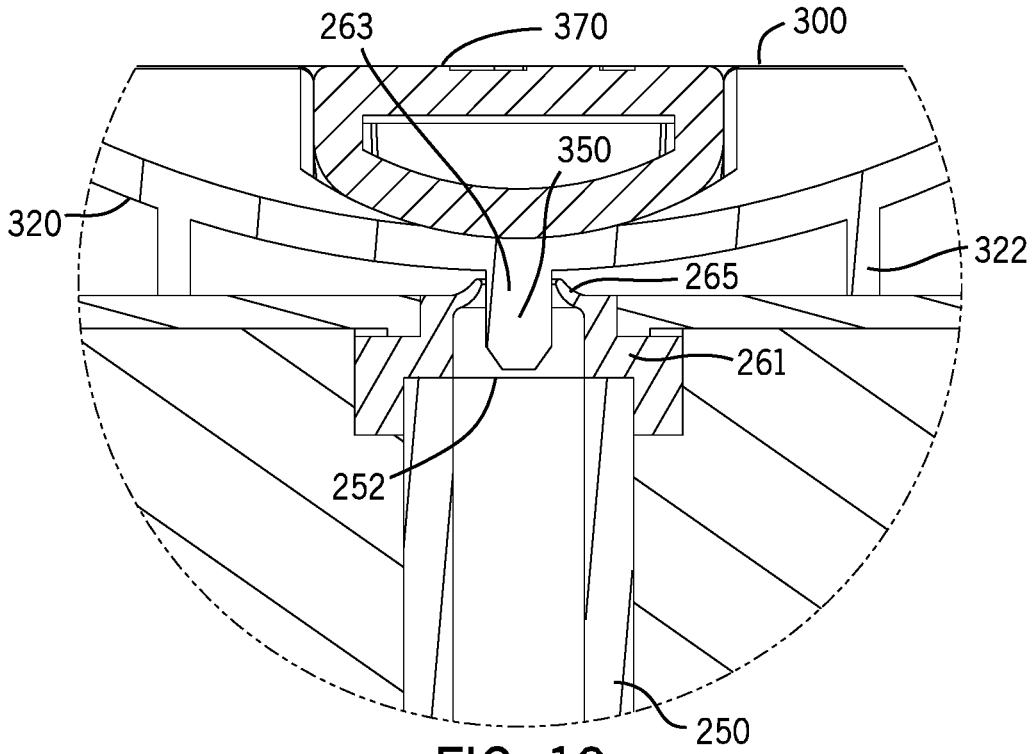
FIG. 10 is a close-up sectional view of another embodiment of the first food jar.

In other aspects as shown in FIGS. 9 and 10, the food jar 10 includes a gasket 261 designed to release pressure into the lid 300 without having to unscrew the lid 300 from the container 100. The gasket 261 includes a gasket opening 263 defined by a flap 265 (or one or more flaps) having a rigidity or flexibility that opens to release pressure from the container 100 into the lid 300. The gasket 261 is positioned at or in the first opening 252 of the vent passage 250. In a normal position with relatively equal pressures in the container 100 and in the ambient environment, the flap 265 seals against the peg 350 to close the vent passage 250. When the pressure in the container 100 elevates to a high pressure condition, the flap 265 will deflect or move outward or upward, thus widening the gasket opening 263, to release pressure from within the container 100. The pressure may pass between the deflecting flap 265 and an outer surface of the peg 350. The gasket 261 provides an automatic release of pressure without having to unscrew the lid 300 or otherwise move the lid 300. The gasket 261 also provides automatic opening to admit ambient air into the food jar 10 in case of a low pressure vacuum condition without having to unscrew the lid 300 or otherwise move the lid 300. In the normal position, the flap 265 extends generally inward against the outer surface of the peg 350. In a high pressure condition, the flap 265 deflects outward—away from the outer surface of the peg 350. By relieving the pressure, the gasket 261 helps to prevent the stopper 200 and/or the lid 300 from moving upward. The flap 265 may also deflect or move inward or downward to relieve a vacuum condition. The materials, shape, and size of the gasket 261 and its flap 265 may be adjusted to provide for the flap 265 to deflect at varying levels of high pressure or low pressure within the container 100.

A second food jar 11 will now be described with references to FIGS. 11-22. The food jar 11 includes a container 400, a stopper 500, and a lid 600.

The container 400 includes a wide mouth opening 402 to readily accept food items such as stews, chili, soups, beverages, or other foods that might not fit so easily into a narrow mouth container. The container 400 may also hold one or more food containers. The one or more food containers may stack in a vertical manner in an interior 404 of the container 400. The container 400 may be vacuum insulated or insulated with an insulating material. The opening 402 leads into the interior 404 of the container 400 that holds the food items or the food containers.

The container 400 includes a neck 410 with a threaded exterior surface 412. The lid 600 includes a threaded internal surface 612. The lid 600 is engaged to the container 400 by threadably engaging the threaded internal surface 612 of the lid 600 with the threaded exterior surface 412 of the neck 410. The neck 410 further includes an internal surface 414.

As the lid 600 is threadably engaged to the container 400, an inner, lower lid surface 620 of the lid 600 urges or presses against the stopper 500 to urge or press the stopper 500 into the opening 402 of the container 400 and against the internal surface 414 of the neck 410. The stopper 500 seals the container 400 to a closed position. The stopper 500 includes a seal 505 to seal against the internal surface 414 of the neck 410 of the container 400. The seal 505 may be positioned on a lower outer diameter of the stopper 500. The lower lid surface 620 of the lid 600 urges or presses against an upper surface 510 of the stopper 500. As the lid 600 is screwed to the container 400, the lower lid surface 620 pushes against the upper surface 510 of the stopper 500 to seal the stopper 500 and its seal 505 to the internal surface 414 of the neck 410.

The lid 600 may include a two-part construction having an inner lid member 610 and an outer lid member 625. In other aspects, the lid 600 may be formed from a single member.

The stopper 500 includes a vent passage 550 that provides for gas/air to pass through the stopper 500. The lower lid surface 620 further includes a peg 650 or other closing member that interacts with the vent passage 550 of the stopper 500. The peg 650 is on the underside of the lid 600. The peg 650 is inserted into a first opening 552 of the vent passage 500 as the lid 600 is screwed onto the container 400, which closes the vent passage 550. The peg 650 is removed from the first opening 552 of the vent passage 550 as the lid 600 is unscrewed from the container 400 to open the vent passage 550. This allows interior pressure within the container 400 to equalize with ambient pressure.

The vent passage 550 includes the first opening 552 communicating with interior space 602 inside of the lid 600 and a second opening 554 communicating with the interior 404 of the container 400. The first opening 552 may be at or in an upper surface 510 of the stopper 500, and the second opening 554 may be at or in a bottom surface 580 of the stopper 500. The vent passage 550 extends a width of the stopper 500, i.e., from the upper surface 510 to the bottom surface 580 and through an interior 595 of the stopper 500. The interior 595 of the stopper 500 may include insulation around the vent passage 550. The vent passage 550 may include a cylindrical member passing through the interior 595 of the stopper 500.

The stopper 500 includes a gasket 560 is positioned proximate the first opening 552. The gasket 560 is at the first opening 552 and includes a gasket opening 562 to receive the peg 650. The gasket 560 is made of resiliently flexible material that seals against the peg 650. The gasket 560 may define or line the first opening 552 of the vent passage 550.

In certain aspects, the stopper 500 includes an upper section 520 and a lower section 530 that contain insulation 540. In other aspects, the stopper 500 may include a one-piece construction. The vent passage 550 may be integrally molded to the lower section 530. The lower section 530 may form the second opening 554 of the stopper 500. The upper section 520 may form the first opening 552 of the stopper 500.

The first opening 552 of the vent passage 550 communicates with the interior space 602 inside of the lid 600. As the lid 600 is unscrewed in a low pressure situation within the container 410, ambient air external to the food jar 400 may pass between the threaded internal surface 612 of the lid 600 and the threaded exterior surface 412 of the neck 410 and into the interior space 602 of the lid 600 in order to relieve the low pressure. This air may pass through the vent passage 550 and into the interior 404 of the container 400. In a high pressure situation within the container 400, air or gas in the interior 404 may exit the container 400 through the vent passage 550, into the interior space 602, and out of the food jar 11 via the threaded internal surface 612 of the lid 600 and the threaded exterior surface 412 of the neck 410.

Figure 12:
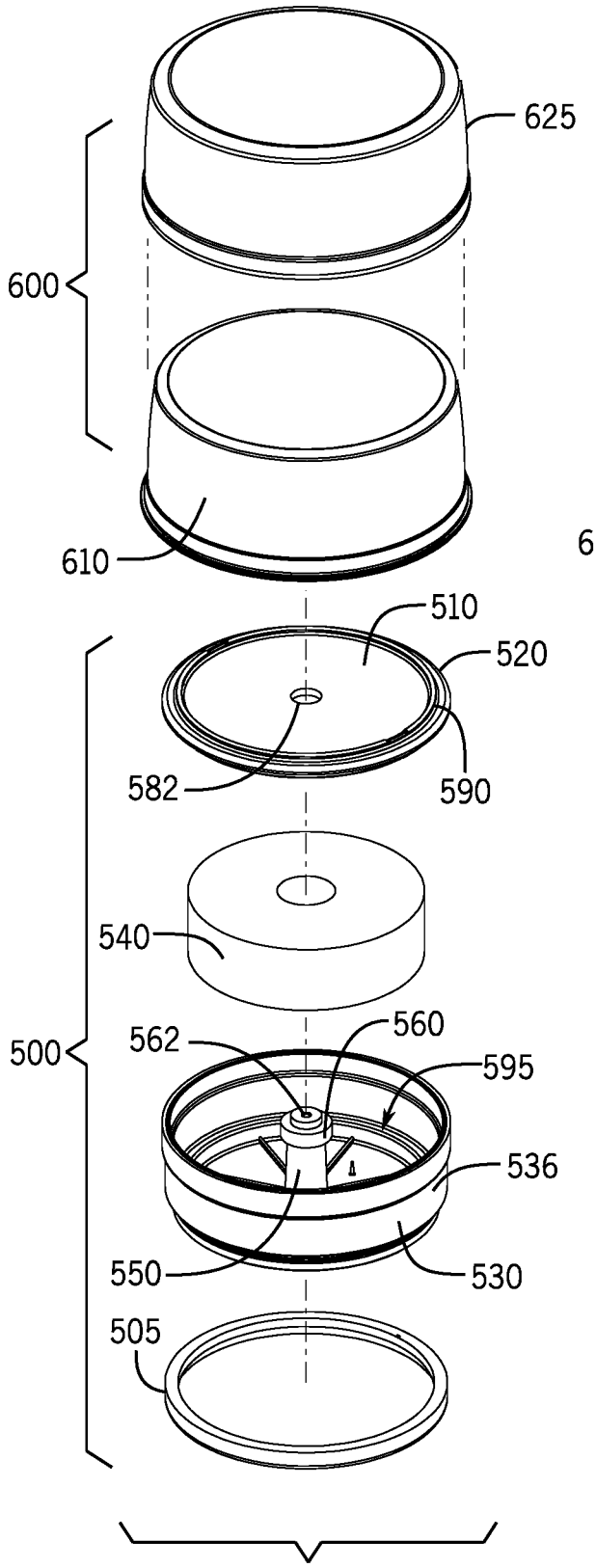
FIG. 12 is an exploded view of an embodiment of the second food jar.

With respect to FIG. 12, the stopper 500 includes the gasket 560 positioned over the first opening 552 of the vent passage 550. In this aspect, the vent passage 550 is integrally molded with the lower section 530 of the stopper 500. The lower section 530 forms a cup-like structure with the vent passage 550 in a center of the lower section. The vent passage 550 passes through an interior of the stopper 500. The upper section 520 joins the lower section 530 to form the stopper 500. The upper section 520 assists in holding the gasket 560 over the first opening 552 of the vent passage 550. Insulation 540 is positioned between the upper section 520 and the lower section 530. The insulation 540 may surround the vent passage 550. The lower section 530 forms the second opening 554 of the vent passage 550. The second opening 554 is flush with a bottom surface 538 of the lower section 530.

A top surface 580 of the upper section 520 includes a top opening 582 that is positioned in-line and over the gasket opening 562 and the first opening 552 of the vent passage 550. The vent passage 550 may have a fluted shape, with the second opening 554 having a larger diameter than the first opening 552. Walls 556 of the vent passage 552 may angle inward when moving from the second opening 554 to the first opening 552. The vent passage 550 includes a cylindrical member that passes from the bottom of the stopper 500, through the entire interior 595 of the stopper 500, and to the top of the stopper 500.

In this aspect, the upper section 520 and the lower section 530 have approximately similar outer diameters. An outer wall 536 of the lower section 530 is generally vertical and joins with the upper section 520 at an outer edge of the upper section 520. When the lid 600 is fully engaged to the container 400, the stopper 500 substantially fills the entire interior of the lid 600.

Figure 13:
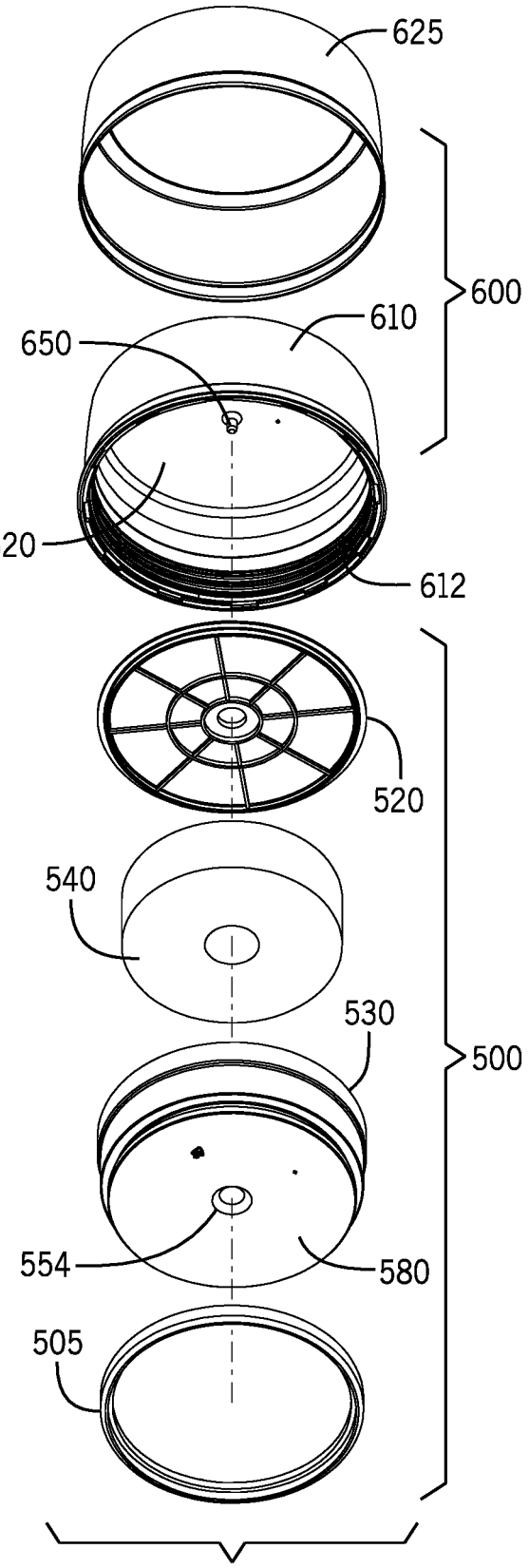
FIG. 13 is an exploded view of an embodiment of the second food jar.
Figure 15:
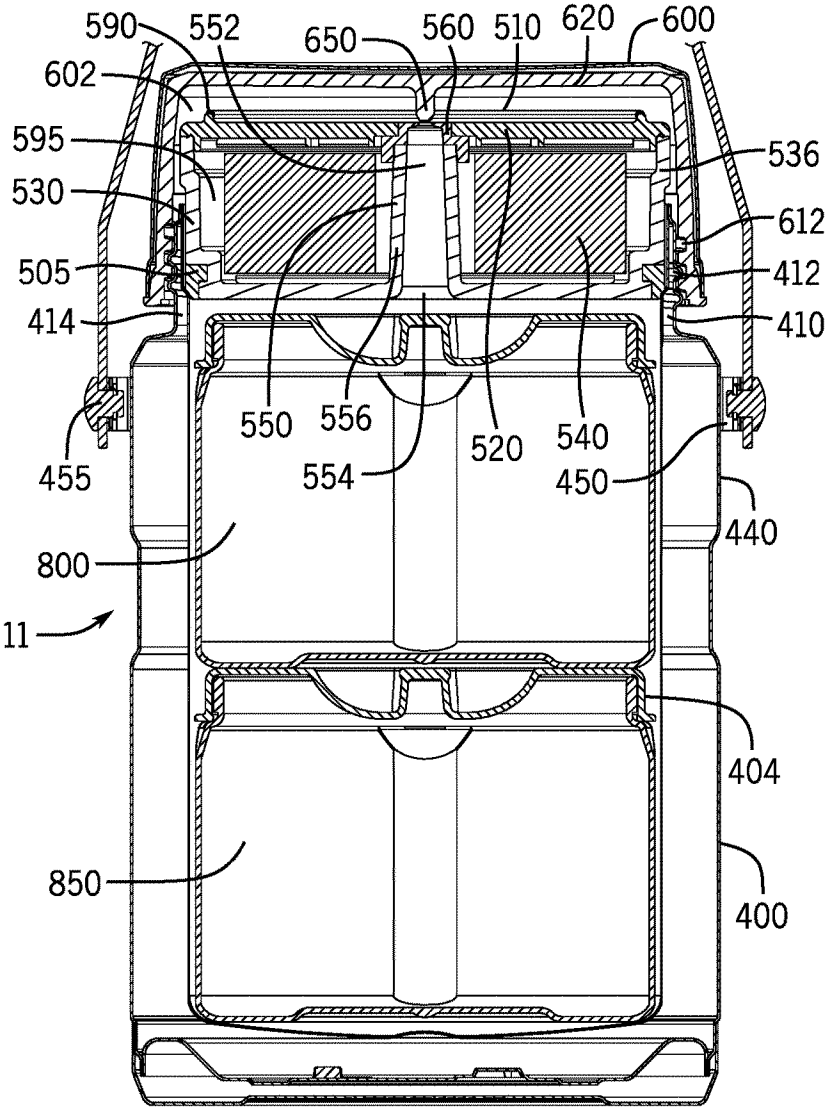
FIG. 15 is a sectional view of an embodiment of the second food jar with the vent passage in an open position.
Figure 14:
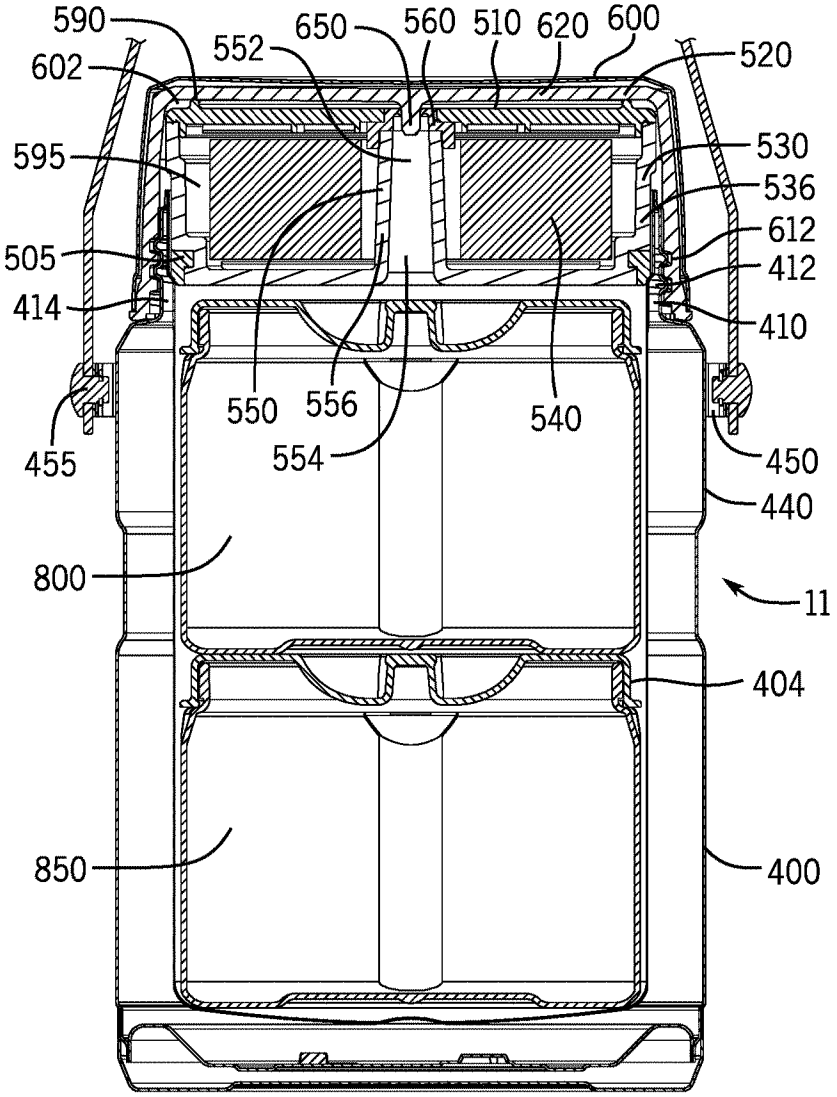
FIG. 14 is a sectional view of an embodiment of the second food jar with the vent passage in a closed position.
Figure 17:
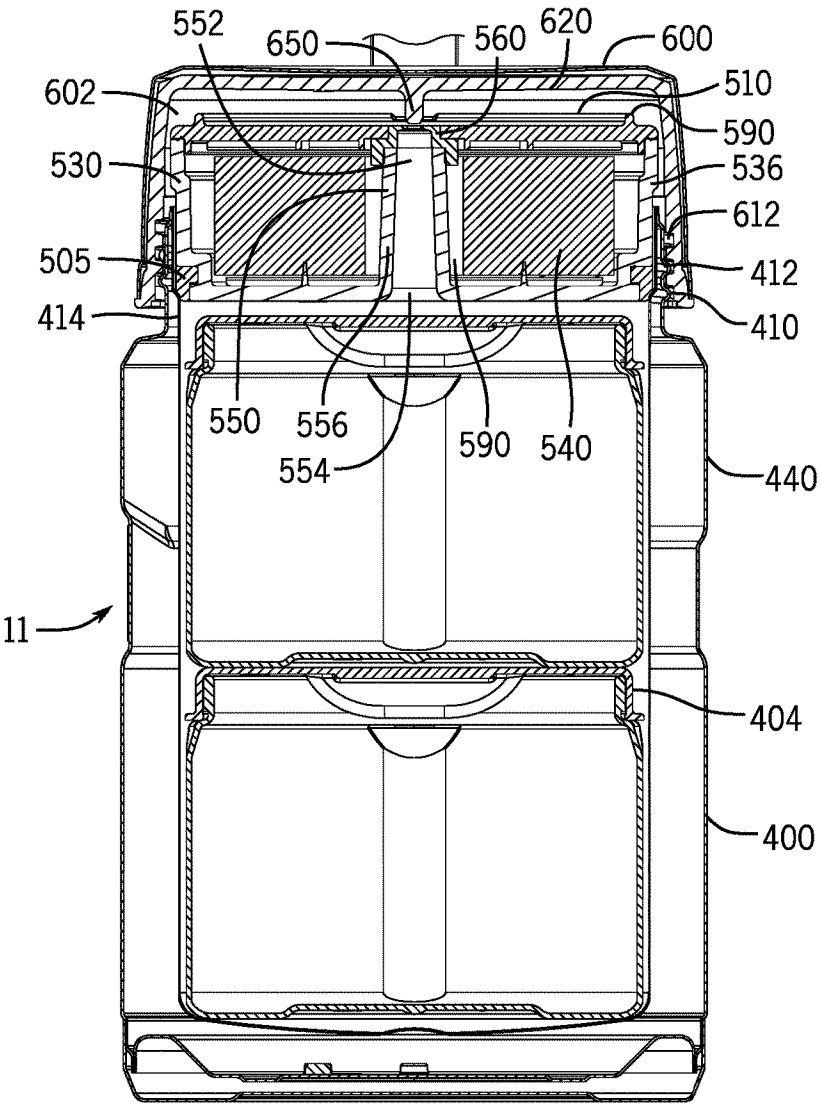
FIG. 17 is a sectional view of an embodiment of the second food jar with the vent passage in an open position.
Figure 16:
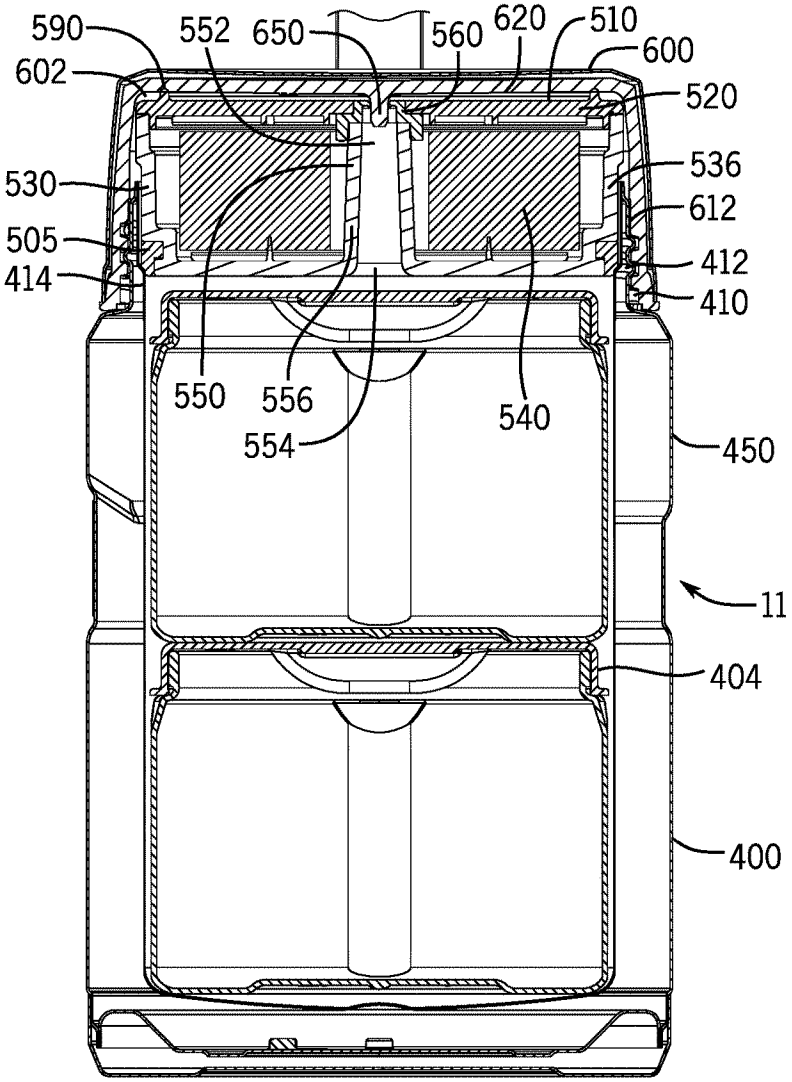
FIG. 16 is a sectional view of an embodiment of the second food jar with the vent passage in a closed position.

With respect to FIG. 13, the lower lid surface 620 of the lid 600 is shown. The peg 650 extends from the lower lid surface 620. This provides for the peg 650 to enter the gasket opening 562 and close the vent passage 550 as the lid 600 is screwed to the container 400. As the lid 600 is screwed to the container 400, the peg 650 moves closer to the gasket opening 562, and, as the lid 600 is further screwed to the container 400, the peg 650 enters or inserts into the gasket opening 562. When the threaded surfaces are fully tightened, the peg 650 is fully inserted into the gasket opening 562 and closes the vent passage 550.

The peg 650 may be centrally located on the lower lid surface 620. A central axis of the peg 650 is aligned with a central axis of the vent passage 550. The lower lid surface 620 may be generally flat. The peg 650 extends from the lower lid surface 620. The top surface 580 of the upper section 520 also includes a projecting member 590 that receives the lower lid surface 620. The projecting member 590 may include a circular shape extending from the top surface 580. When the lid 600 is tightened, the lower lid surface 620 presses down against the projecting member 590 of the stopper 500 to uniformly and evenly seal the stopper 500 to the container 600.

The vent passage 550 of the food jar 11 releases pressure from within the container 400 before the lid 600 is fully twisted off. When the lid 600 is at least partially unscrewed, the vent passage 550 is opened to vent the interior of the container 400 in a controlled manner. This is advantageous since there is a possibility that pressure may build up in the interior of the container 400 if the container 400 has been agitated or the food has been stored in the container 400 for too long. The partial unscrewing of the lid 600 may open the vent passage 550 of the food jar 11 to releases a vacuum that may form within the container 400 if the food item has cooled in the food jar 11. This provides for easier removal of the lid 600. The vent passage 550 is able to relieve pressure within the container without totally removing the lid 600, which helps reduce inadvertent food spray when the high pressure within the container 400 is relieved.

The peg 650 includes other closing members, descending members, plugs, stoppers, extensions, etc. positioned or formed on the lid 600 or other first closing member that inserts into, seals, blocks, or otherwise closes a vent on the stopper 500 or second closing member. The screwing of the lid 600 to the container 400 aligns the closing member with the first opening 552 and the gasket opening 562 of the vent passage 550.

In certain aspects, the lid 600 and its peg 650 are completely removable or completely separable from the container 400 and the stopper 500.

Figure 11:
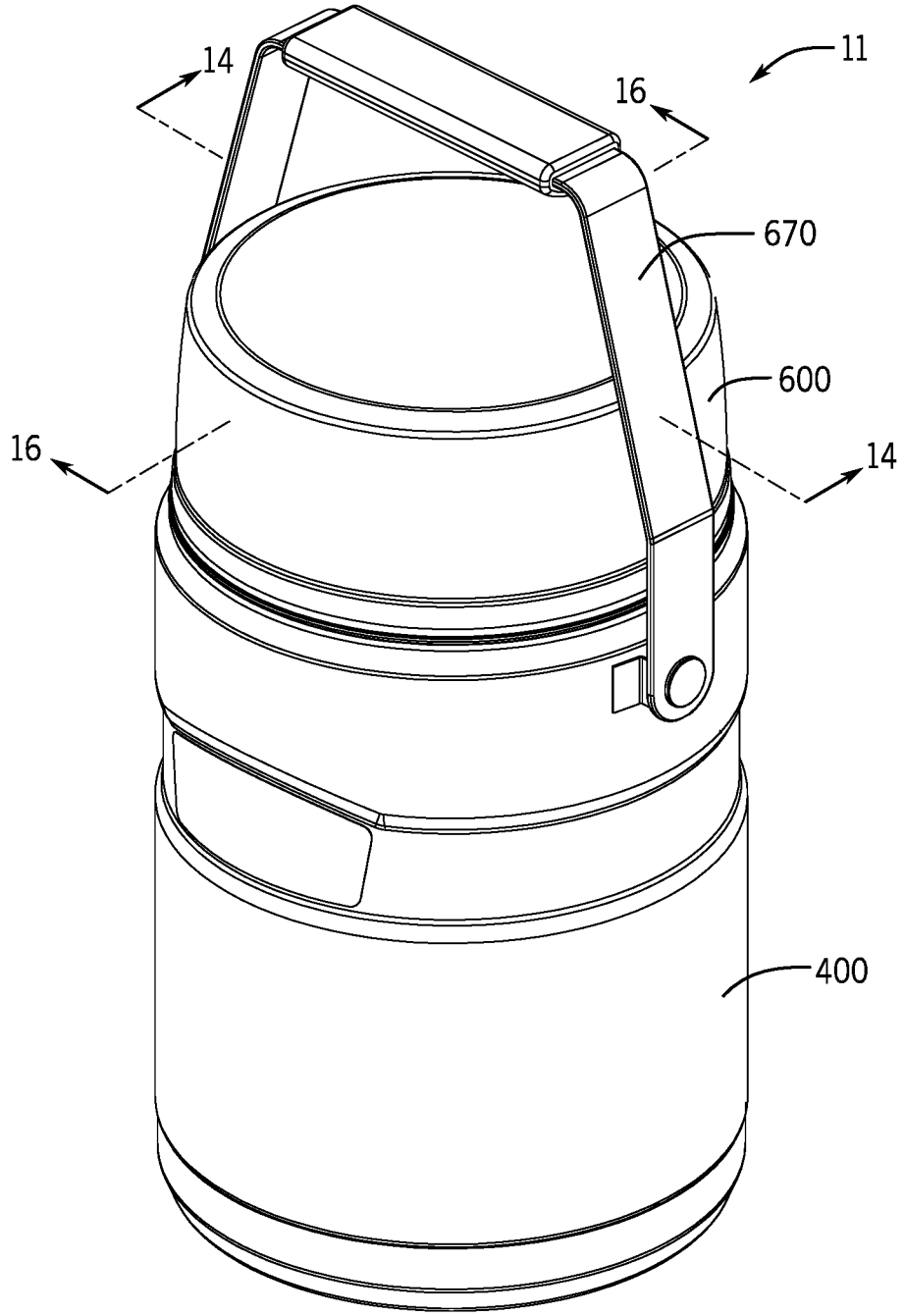
FIG. 11 is a perspective view of an embodiment of a second food jar with a second stopper.

With respect to FIG. 11, a handle 670 may engage to sidewalls 440 of the container 400. The handle 670 may pivot or rotate over the lid 600. The handle 670 may pivot or rotate from a front to a back of the container 400. As the container 400 may be configured, in certain aspects, to contain several liters of the food item, the handle 670 provides assistance to the user in carrying the loaded food jar 11, which may weigh up to 5 pounds or more, when fully loaded with the food item. The handle 670 is pivotally or rotatably mounted to posts 450 and 455, which may be positioned on opposite sides of the container 400. In other aspects, the food jar 11 may omit the handle 670 or include a fixed handle or other carrying structure, such as a carrying loop.

In other aspects, lid 600 may include multiple pegs 650 or other closing members that engage with multiple vents or vent passages 550.

Figure 18:
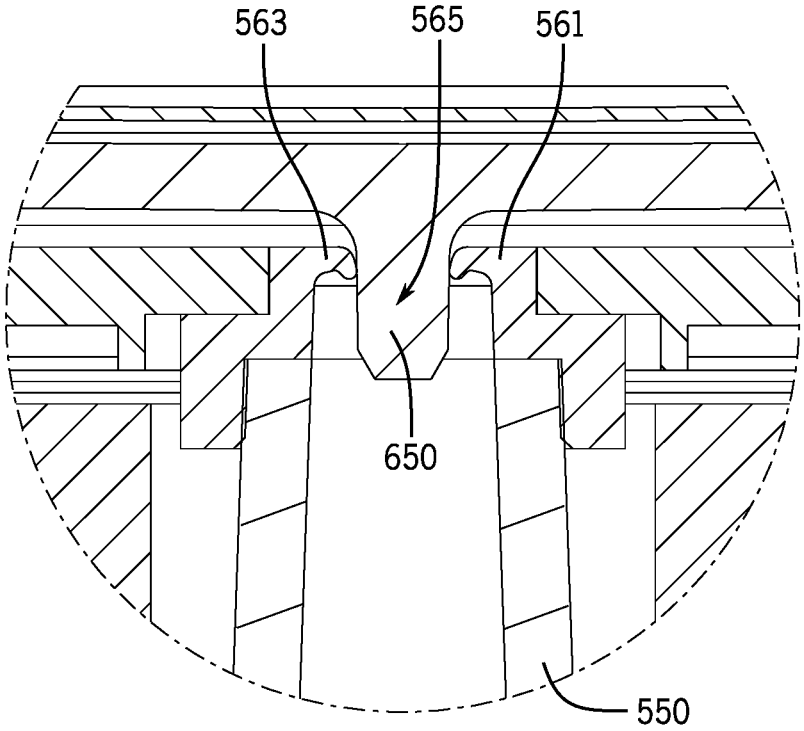
FIG. 18 is a close-up sectional view of another embodiment of the gasket for the second food jar.
Figure 19:
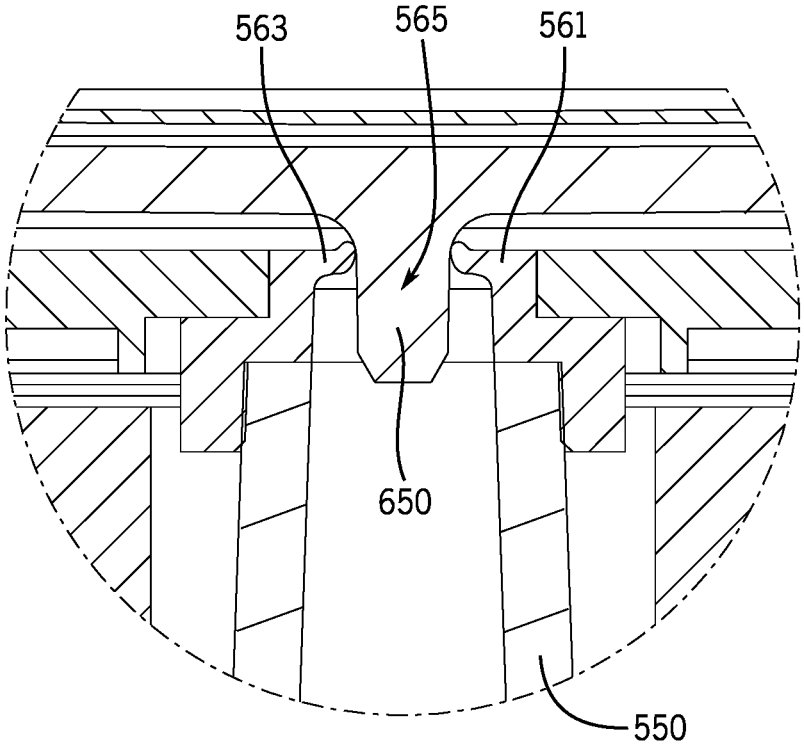
FIG. 19 is a close-up sectional view of another embodiment of the gasket for the second food jar.
Figure 20:
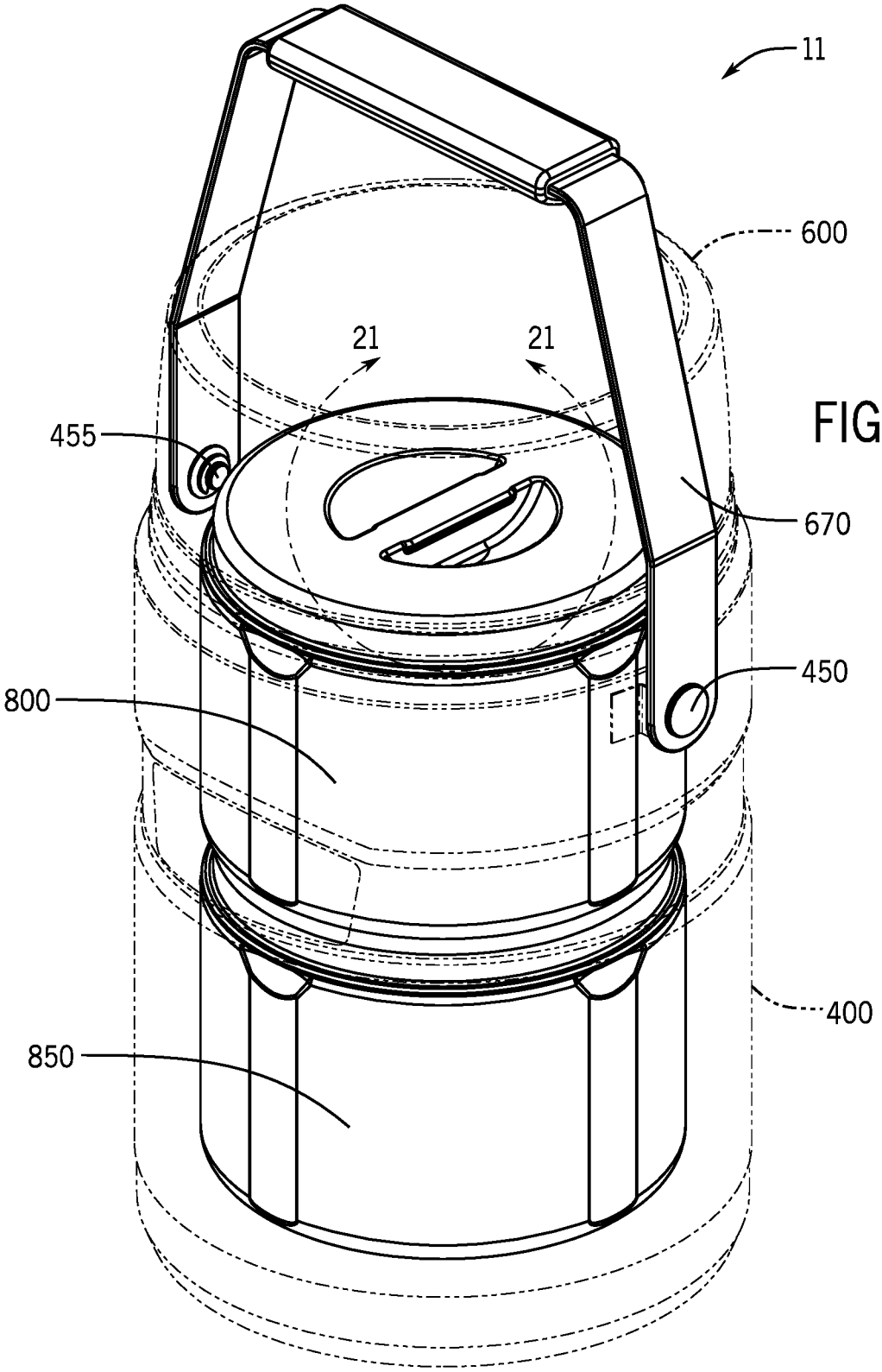
FIG. 20 is a view showing containers stacked in the second food jar.

In other aspects as shown in FIGS. 18 and 19, the food jar 11 includes a gasket 561 designed to release pressure into the lid 600 without having to unscrew the lid 600 from the container 400. The gasket 561 includes a gasket opening 565 defined by a flap 563 (or one or more flaps) having a rigidity or flexibility that opens to release pressure from the container 400 into the lid 600. The gasket 561 is positioned at the first opening 552 of the vent passage 550. In a normal position with relatively equal pressures in the container 400 and in the ambient environment, the flap 563 seals against the peg 650 to close the vent passage 550. When the pressure in the container 400 elevates to a high pressure condition, the flap 563 will deflect outward or upward, thus widening the gasket opening 565, to release pressure from within the container 400. The pressure may pass between the deflecting flap 563 and an outer surface of the peg 650. The gasket 561 provides an automatic release of pressure without having to unscrew the lid 600 or otherwise move the lid 600. In the normal position, the flap 563 extends generally inward against the outer surface of the peg 650. In a high pressure condition, the flap 563 deflects outward—away from the outer surface of the peg 650. By relieving the pressure, the gasket 561 helps to prevent the stopper 500 and/or the lid 600 from moving upward. In a low pressure condition, the flap 563 deflects inward or downward—away from the outer surface of the peg 650 to admit ambient air into food jar 11. The materials, shape, and size of the gasket 561 and its flap 563 may be adjusted to provide for the flap 563 to deflect at varying levels of high pressure or low pressure within the container 400.

Figure 21:
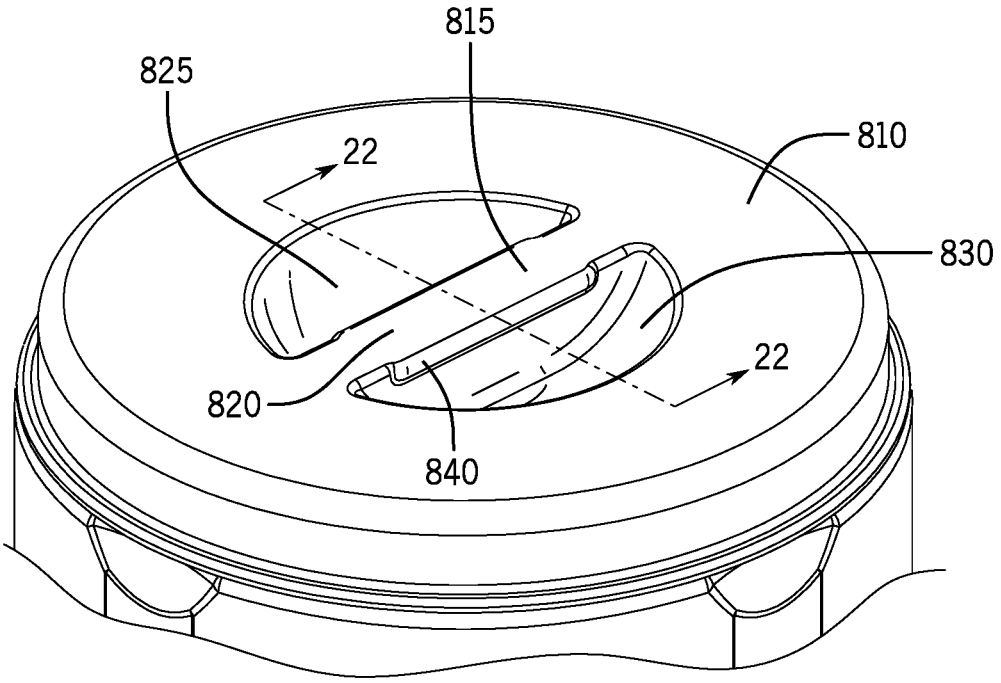
FIG. 21 is a perspective view of the container and lid that may fit in the second food jar.
Figure 22:
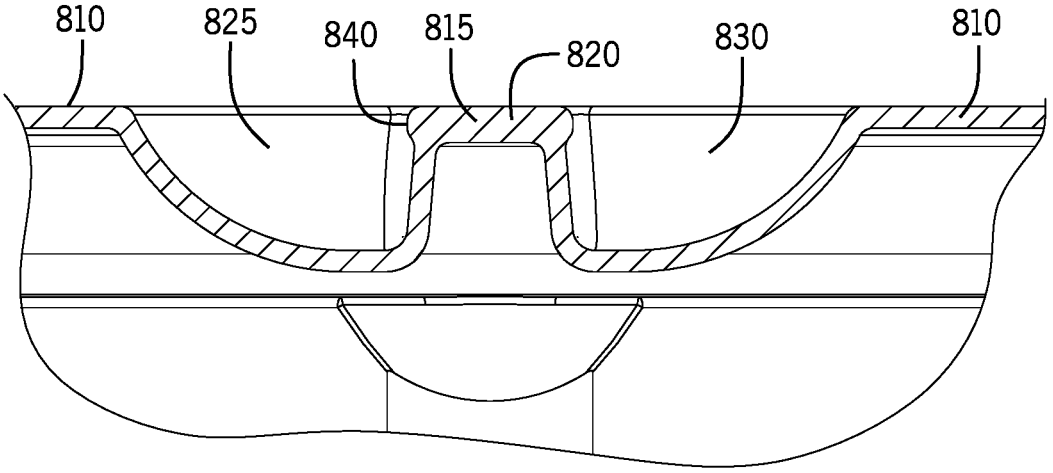
FIG. 22 is sectional view of the container and lid that may fit in the second food jar.
Figure 23:
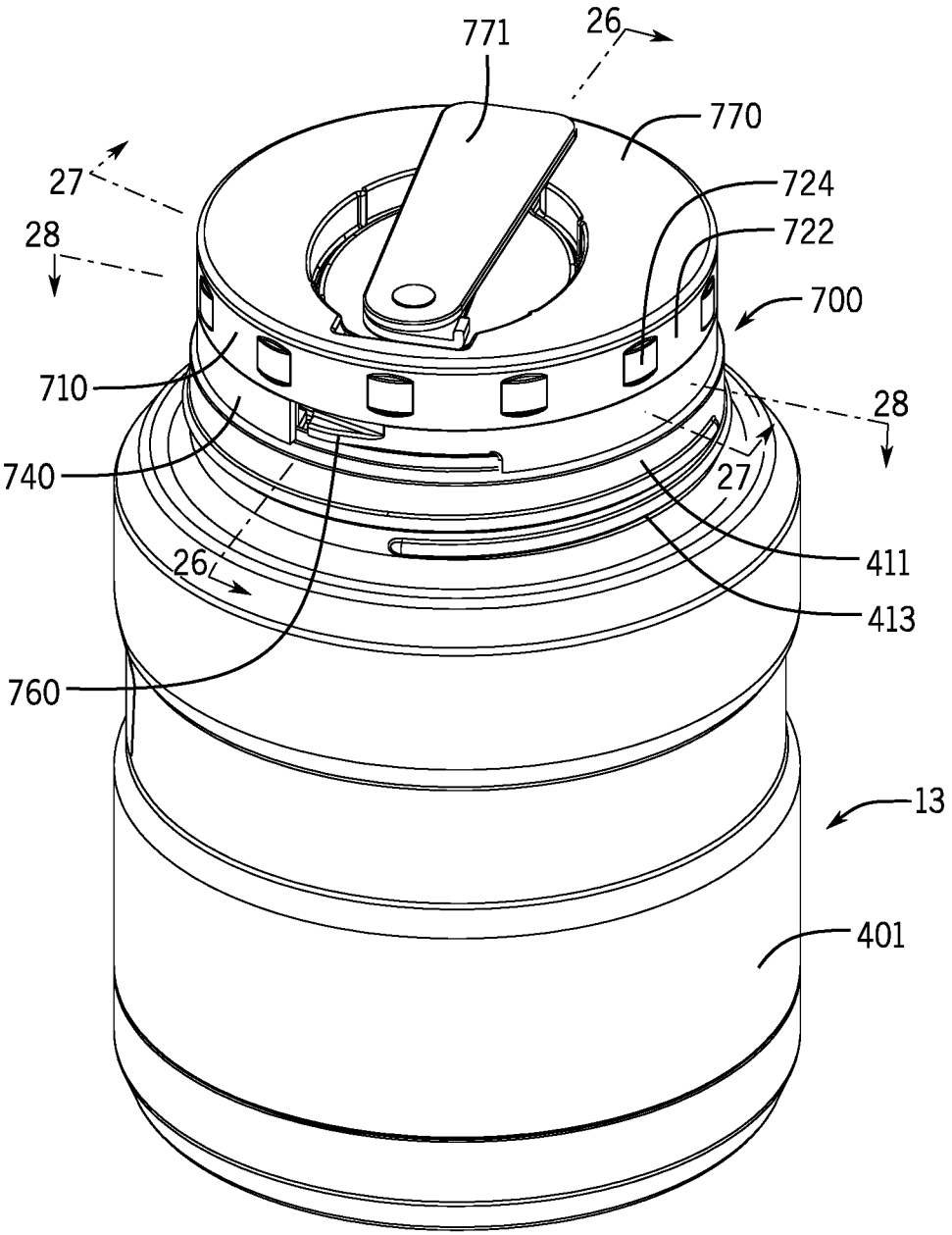
FIG. 23 is a perspective view of an embodiment of a third food jar with a third stopper.

In FIGS. 14-17 and 20, the food jar 11 is shown holding a first container 800 and a second container 850 in the interior 404 of the container 400. The first and second containers 800 and 850 are in a vertically stacked arrangement. In other aspects, fewer or additional containers may be held in the interior 404. As shown in FIGS. 21 and 22, the container 800 includes a lid 810 that threadably engages or screws on to the container 800. Of course, the first and second containers 800 and 850 may be held within the food jar 10 of FIGS. 1-10.

The lid 810 includes a grip 815 that is easy for the user to grasp and rotate in order to open and close the container 800. If a vacuum has formed in the container 800 due to, for example, cooling of the food product, the grip 815 helps the user to overcome the force of the vacuum. The grip 815 has a central member 820 with two concave portions 825 and 830 on opposite sides of the central member 820. The two concave portions 825 and 830 may be recesses molded into the lid 800. The two concave portions 825 and 830 may be below a surface 835 of the lid 810.

The central member 820 further includes a flange portion 840 extending perpendicular to the central member 820. The flange portion 840 may extend from a middle portion of the central member 820 and not from portions or ends of the central member near walls of the concave portions 825 and 830. Thus, a width of the central member 820 may be narrower near its opposing ends. The combination of these features provides for the user's fingers to obtain a good grip on the central member 820 in order unscrew the lid 810.

In other aspects, as described below, the stopper may include an upper stopper and a lower stopper. The upper stopper is shaped or configured to be complementary with the lower stopper. The combination of the upper stopper and the lower stopper close an opening of a container to maintain the contents of the container in the container without leakage or with minimal leakage of the contents from the container. The upper stopper and the lower stopper also operate together to form a vent for the container. The vent may relieve pressure from within the container before the stopper is completely removed from the container. The vent may be opened with only a partial unscrewing or removal of the upper stopper from the lower stopper. Since the upper stopper does not need to be completely removed for the vent to be opened, the release of pressure by the vent helps to minimize the likelihood of the stopper coming off forcefully or at least minimize the force upon the stopper release. The opening of the vent may also reduce a vacuum within the container, which may make the container difficult to open. In some aspects, the vent may also provide an automatic release of pressure without having to unscrew the upper stopper or otherwise move the upper stopper. When pressure is very low or very high in the container, the vent may also open to release gas from within the container or to admit ambient air into the container. As such, the vent may act as an automatic pressure relief valve for the container.

The lower stopper includes or forms a vent passage for the vent. The upper stopper includes a closing member, such as a peg, descending member, stopper, plug, extension, etc. positioned on a lower or bottom surface of the upper stopper. The vent passage and the closing member operate together to form the vent. The lower stopper receives the upper stopper such that the closing member of the upper stopper inserts into, seals, blocks, or otherwise closes the vent passage of the lower stopper. This interaction opens and closes the vent passage of the lower stopper as the upper stopper is unscrewed from or screwed to the lower stopper.

In some aspects, a gasket with a gasket opening and a flap is positioned at or in the vent passage. The closing member enters the gasket opening. The flap urges against the closing member to close the vent passage. When there is high pressure in the container, the flap may deflect in one direction to release gas from the container. When there is low pressure in the container, the flap may deflect in another direction to admit ambient air into the container.

With reference to FIGS. 23-33, a stopper 700 is shown. The stopper 700 may be used with a container 401 to form a food jar 13. The stopper 700 includes an upper stopper 710 and a lower stopper 740. The stopper 700 is shown with the container 401 having a wide mouth opening 403 to readily accept food items such as stews, chili, soups, beverages, or other foods that might not fit so easily into a narrow mouth container. The container 401 may also hold one or more food containers. The stopper 700 may also be sized and shaped to fit other containers with narrower necks and openings.

The container 401 includes a neck 411 with a threaded exterior surface 413. A lid may engage to the container 401. The lid includes a threaded internal surface. The lid is engaged to the container 401 by threadably engaging the threaded internal surface of the lid with the threaded exterior surface 413 of the neck 411. The neck 411 further includes a threaded internal surface 415. The lower stopper 740 includes a threaded external surface 741 to threadably engage with the threaded internal surface 415 of the neck 411.

Figure 26:
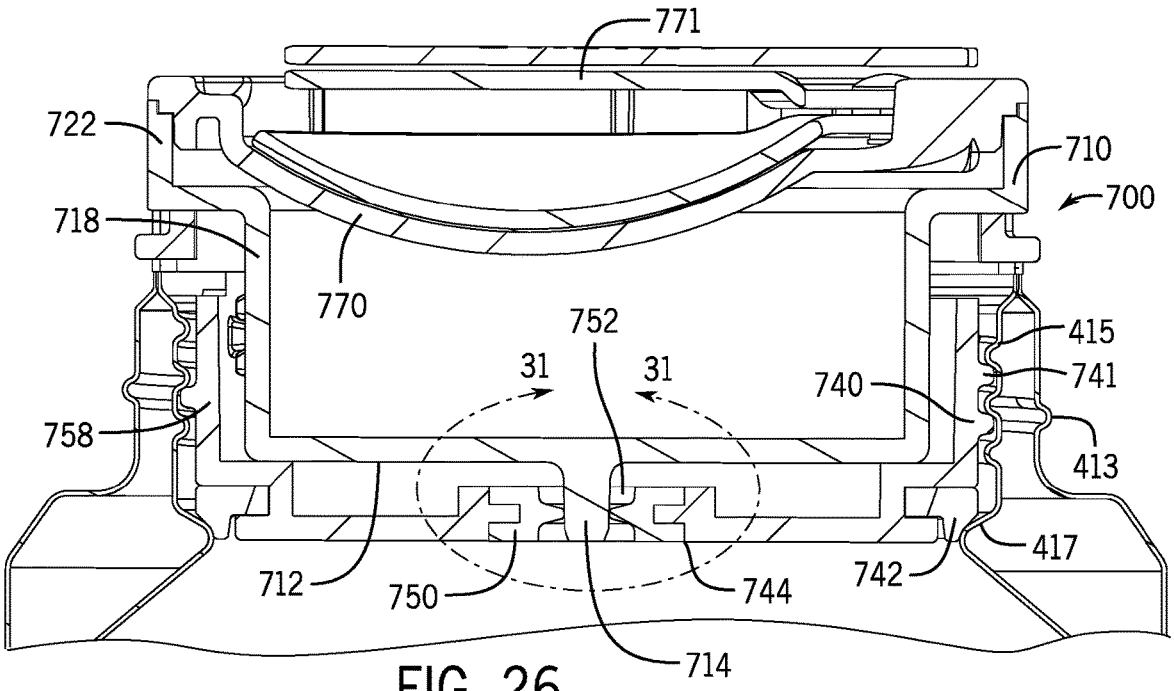
FIG. 26 is a sectional view of an embodiment of a stopper of the third food jar.
Figure 27:
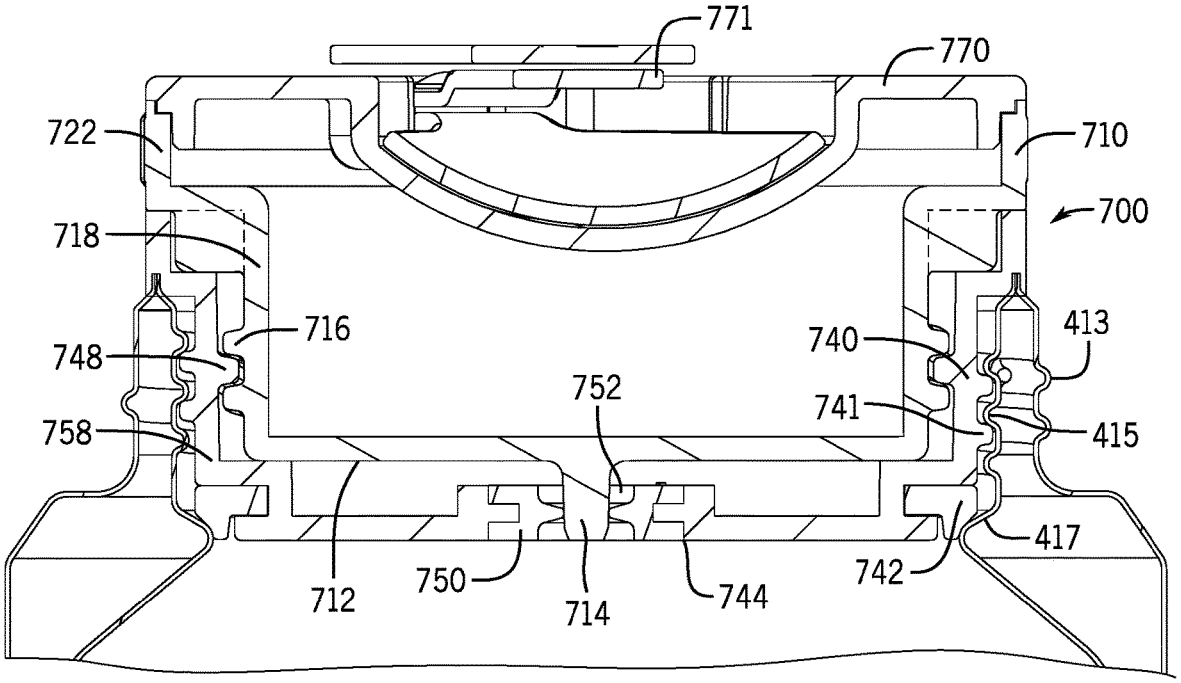
FIG. 27 is a sectional view of an embodiment of a stopper of the third food jar.

With reference to FIGS. 26 and 27, as the stopper 700 is threadably engaged to the container 401, a lower stopper seal 742 of the lower stopper 740 is urged or pressed against an internal surface 417 of the neck 411 or the container 401 to seal the container 401 to a closed position. The lower stopper seal 742 may be positioned on a lower, outer diameter of the lower stopper 740.

The lower stopper 740 includes a vent passage 744 that provides for gas/air to pass to or from the container 401. In this aspect, the vent passage 744 may include an opening in the lower stopper 740. The upper stopper 710 includes a lower surface 712 that includes or forms a closing member 714 that interacts with the vent passage 744 of the lower stopper 740. The closing member 714 is on the underside of the upper stopper 710. The closing member 714 is inserted into the vent passage 744 as the upper stopper 710 is screwed into the lower stopper 740, which closes the vent passage 744. The closing member 714 is removed from the vent passage 744 as the upper stopper 710 is unscrewed from the lower stopper 740 to open the vent passage 744. This allows interior pressure within the container 401 to equalize with ambient pressure.

The upper stopper 710 threadably fits into an interior 746 the lower stopper 740. The upper stopper 710 includes a sidewall 718 with a threaded external surface 716. The lower stopper 740 includes a sidewall 758 with a threaded internal surface 748. When the upper stopper 710 is screwed to the lower stopper 740, the threaded external surface 716 of the exterior of the upper stopper 710 threadably engages with the threaded internal surface 748 of the interior of the lower stopper 740. The upper stopper 710 further includes an upper rim 722 with gripping surfaces 724 for the user to grip onto while rotating the upper stopper 710.

Figure 28:
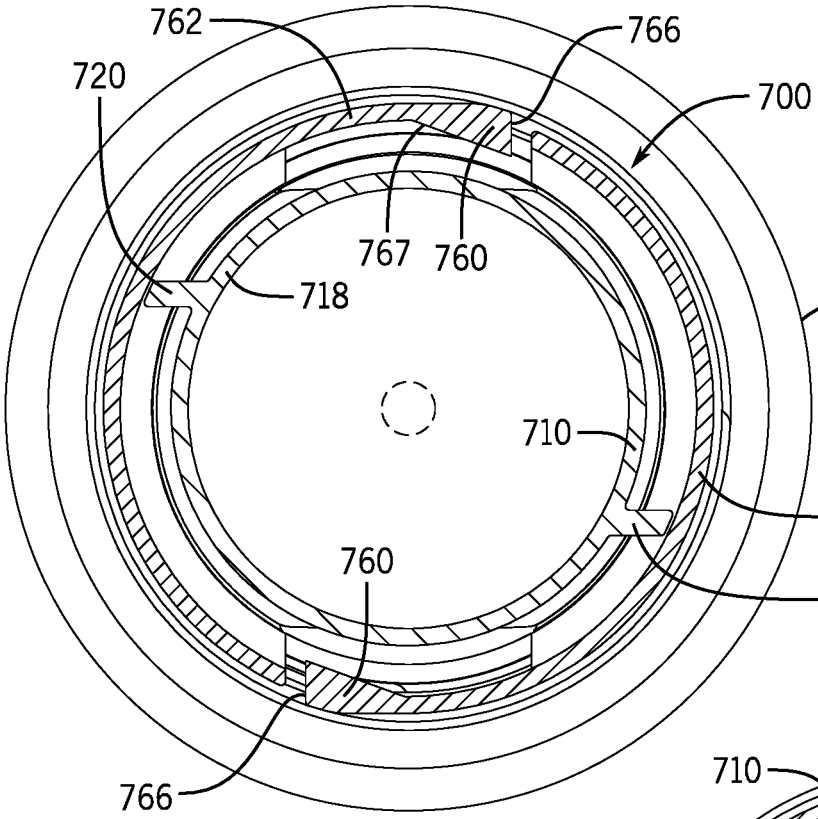
FIG. 28 is a top down view of an embodiment of the stopper of the third food jar.
Figure 30:
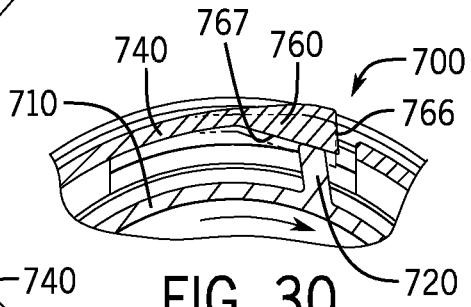
FIG. 30 is a top down view of an embodiment of the stopper of the third food jar.

With respect to FIG. 28, the sidewall 718 of the upper stopper 710 further includes one or more projecting members 720 that extend outward from the sidewall 718. The projecting members 720 engage with one or more flexible catches 760 formed in an upper rim 762 of the sidewall 758 of the lower stopper 740. The flexible catches 760 may be formed proximate relief cuts 761 in the sidewall 758. The flexible catches 760 project or extend inward towards a center of the lower stopper 740. The flexible catches 760 are configured to deflect or bend outward, i.e., away from the center of the lower stopper 740. As the user unscrews the upper stopper 710, the projecting members 720 will ultimately contact and engage ends 766 of the flexible catches 760 and drive the lower stopper 740 in the same unscrewing direction. In contrast, as shown in FIG. 30, when the upper stopper 710 is tightened to the lower stopper 740, the projecting members 720 contact an interior surface 767 of the flexible catches 760 and deflect the flexible catches 760 outward. As such, the flexible catches 760 do not interfere with the tightening of the upper stopper to 710 to the lower stopper 740.

Figure 29:
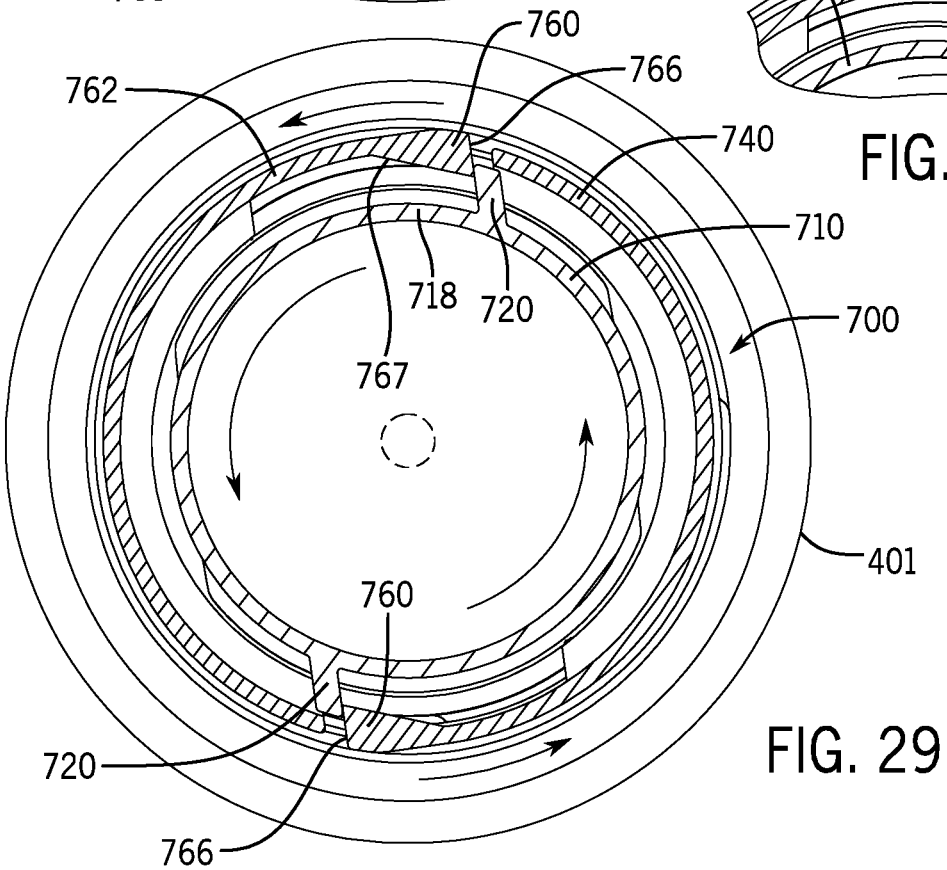
FIG. 29 is a top down view of an embodiment of the stopper of the third food jar.

With respect to FIG. 29, the projecting members 720 are spaced on the sidewall 718 to provide for the upper stopper 710 to unscrew sufficiently to withdraw the closing member 714 from the vent passage 744 before the projecting members 720 engage the ends 766 of the flexible catches 760 to drive lower stopper 740 in the same unscrewing direction. This opens the vent passage 744 to allow the pressure within the container to equilibrate with the ambient environment before unscrewing the lower stopper 740 from the container 401.

The vent passage 744 includes a gasket 750 with a gasket opening 752. The gasket 750 is made of a resiliently flexible material that seals against the vent passage 744. The gasket 750 may define or line the vent passage 744.

As the upper stopper 710 is unscrewed in a low pressure situation within the container 401, ambient air external to the food jar 13 may pass through the vent passage 744 and into the interior of the container 401 in order to relieve the vacuum. In a high pressure situation within the container 401, air or gas in the interior may exit the container 401 through the vent passage 744, and out of the food jar 13.

Figure 24:
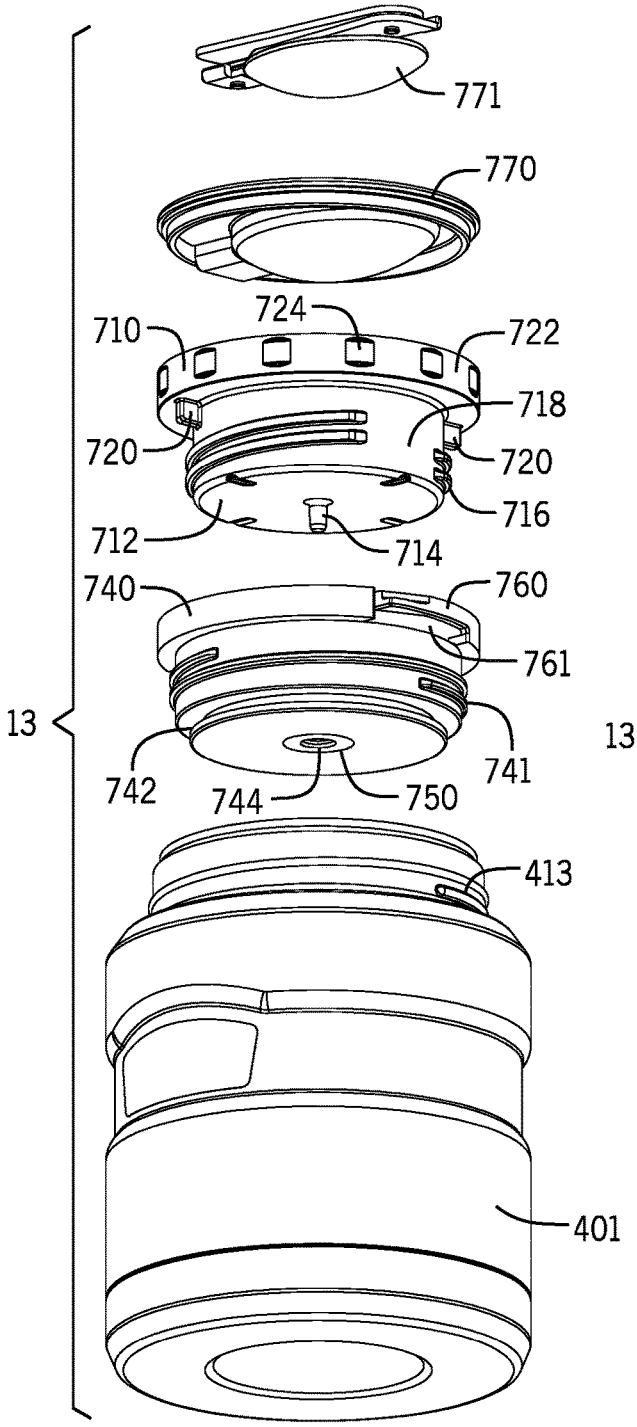
FIG. 24 is an exploded view of an embodiment of the third food jar.
Figure 25:
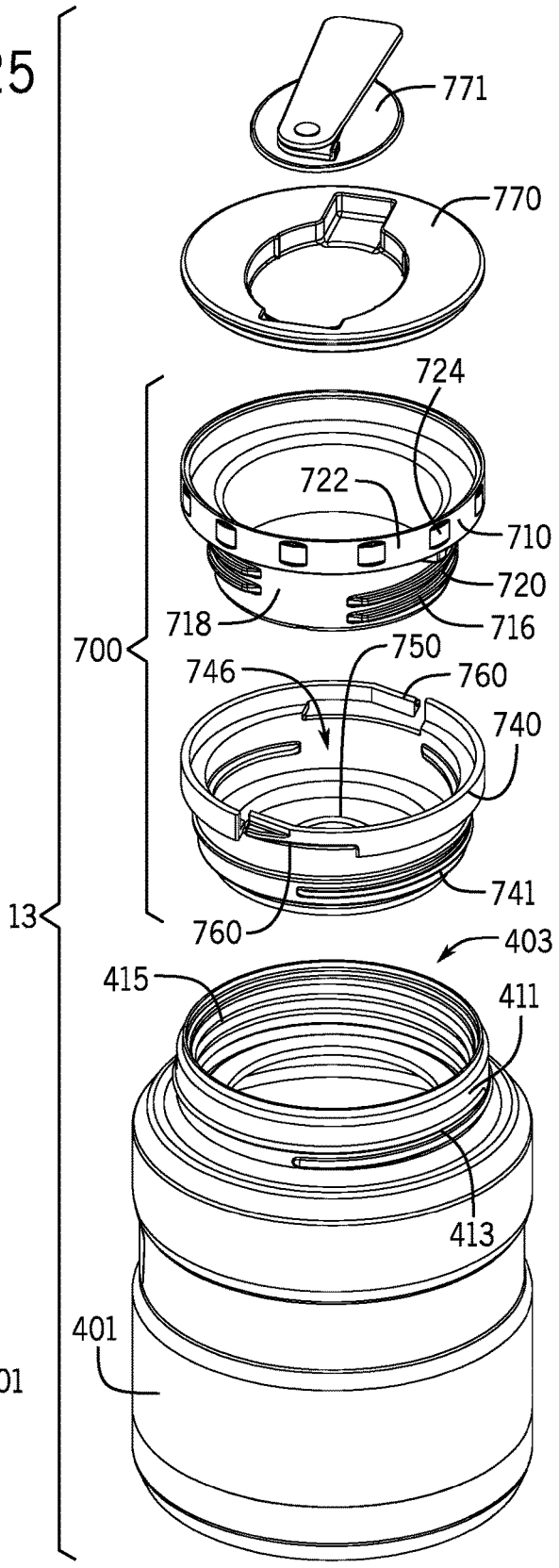
FIG. 25 is an exploded view of an embodiment of the third food jar.

With respect to FIG. 24, the lower surface 712 of the upper stopper 710 is shown. The closing member 714 extends or projects from the lower surface 712. This provides for the closing member 714 to enter the gasket opening 752 and close the vent passage 744 as the stopper 700 is screwed to the container 401. As the stopper 700 is screwed to the container 401, the closing member 714 moves closer to the gasket opening 752, and, as the stopper 700 is further screwed to the container 401, the closing member 714 enters or inserts into the gasket opening 752. When the threaded surfaces are fully tightened, the closing member 714 is fully inserted into the gasket opening 752 and closes the gasket 750.

The closing member 714 may be centrally located on the lower surface 712. A central axis of the closing member 714 is aligned with a central axis of the vent passage 744. The lower surface 712 of the upper stopper 710 may be generally flat. The closing member 714 extends or projects from the lower surface 712 of the upper stopper 710.

The vent passage 744 of the stopper 700 releases pressure from within the container 401 before the stopper 700 is fully twisted off of the container 401. When the stopper 700 is at least partially unscrewed, the vent passage 744 is opened to vent the interior of the container 401 in a controlled manner. This is advantageous since there is a possibility that pressure may build up in the interior of the container 401 when the container 401 has been agitated or the food has been stored in the container 401 for too long. The partial unscrewing of the stopper 700 may open the vent passage 744 of the stopper 700 to release a vacuum that has formed within the container 401 when the food item has cooled in the food jar 13. This provides for easier removal of the stopper 700. The vent passage 744 is able to relieve pressure within the container 401 without totally removing the stopper 700, which helps reduce inadvertent food spray when the high pressure within the container 401 is relieved.

The closing member 714 may include other closing members, descending members, plugs, stoppers, extensions, etc. positioned or formed on or of the upper stopper 710 that inserts into, seals, blocks, or otherwise closes a vent of the lower stopper 740. The screwing of the upper stopper 710 to the container lower stopper 740 aligns the closing member 714 with the gasket opening 752 of the vent passage 744.

The gasket 750 is also designed to release pressure from the container 401 and allow ambient air to enter the container 401 to relieve a vacuum condition in the container 401 without having to unscrew the stopper 700 from the container 401. The gasket 750 includes the gasket opening 752 defined by a flap 763 (or one or more flaps) having a rigidity or flexibility that deflect to release pressure from the container 401 or admit ambient air into the container to relieve a vacuum condition within the container 401. In a resting state, the flaps 763 generally extend inward to a center of the gasket opening 752. The flaps 763 may extend inward, in a generally perpendicular fashion, from an inner wall 768 of the gasket 750. The inner wall 768 may define the gasket opening 752. In the aspect shown, in a fully closed position, the closing member 714 enters the gasket opening 752 and moves past the flaps 763.

Figure 31:
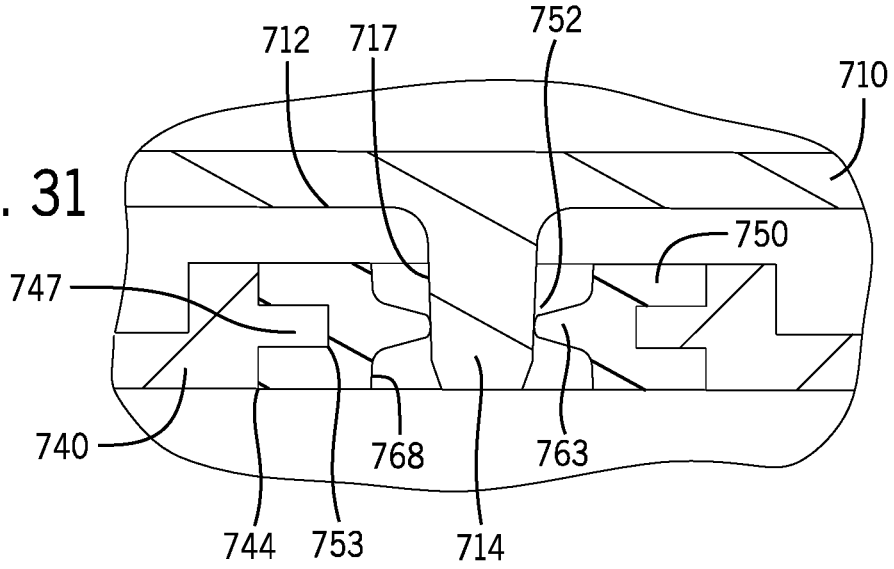
FIG. 31 is a sectional view of an embodiment of a gasket.
Figure 32:
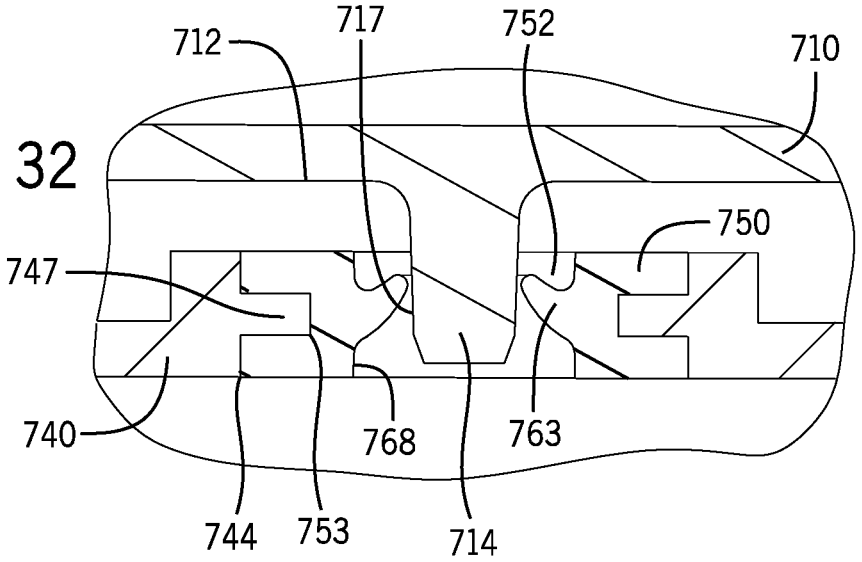
FIG. 32 is a sectional view of an embodiment of a gasket with the flap deflecting upward.
Figure 33:
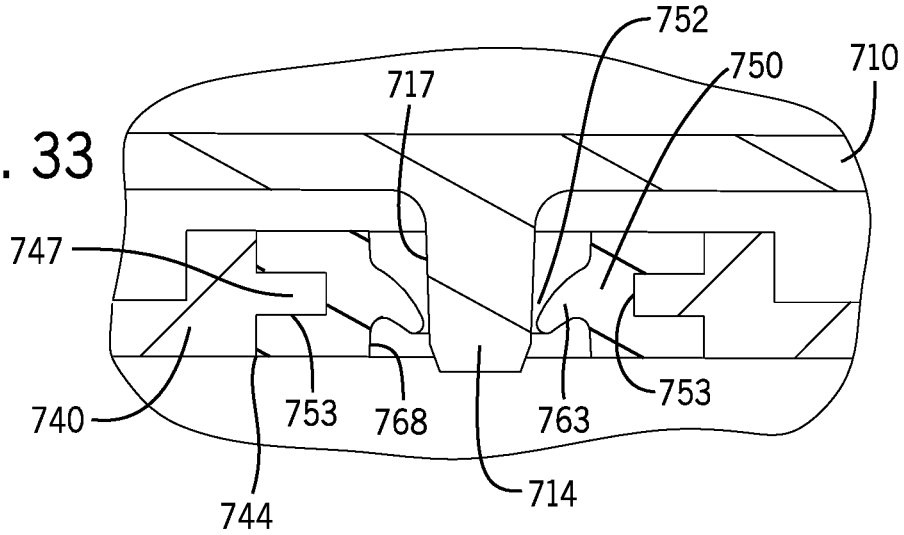
FIG. 33 is a sectional view of an embodiment of a gasket with the flap deflecting downward
Figure 34:
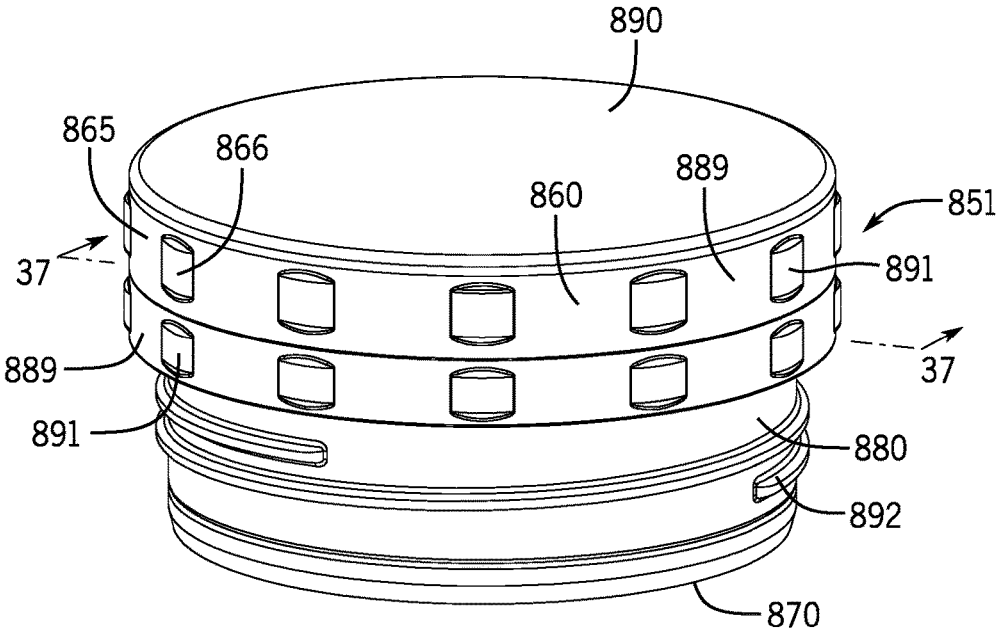
FIG. 34 is a perspective view of an embodiment of a fourth stopper.
Figure 37:
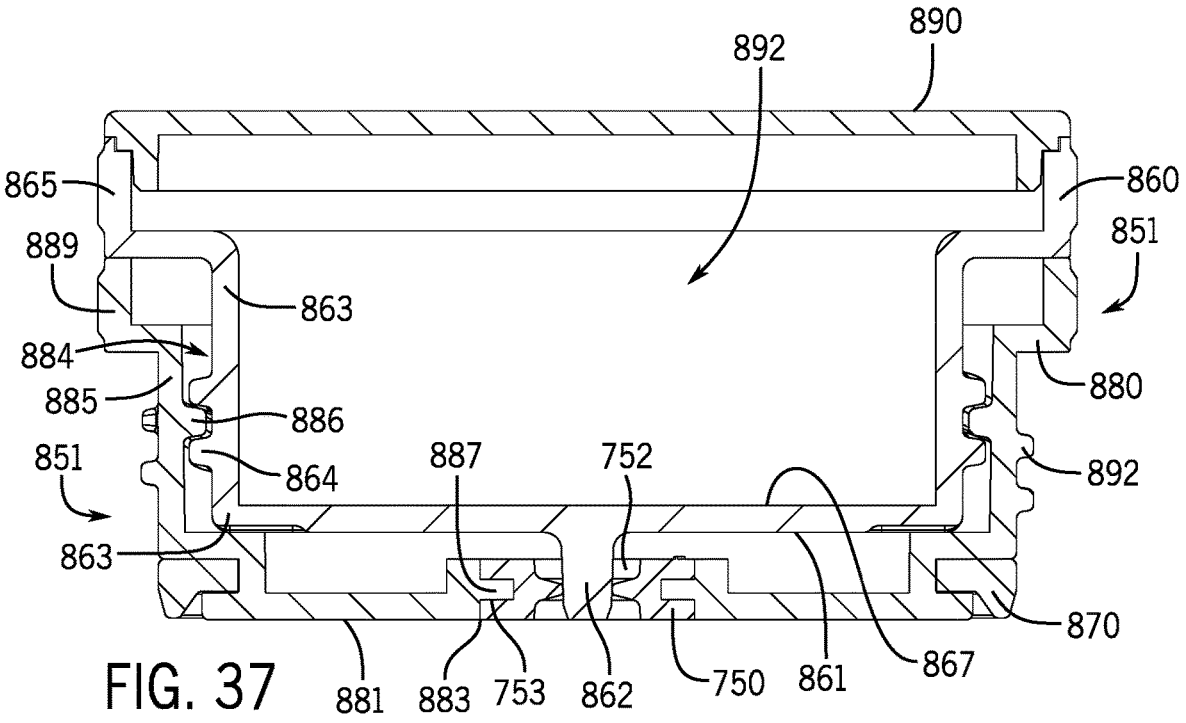
FIG. 37 is a sectional view of an embodiment of the fourth stopper.
Figure 35:
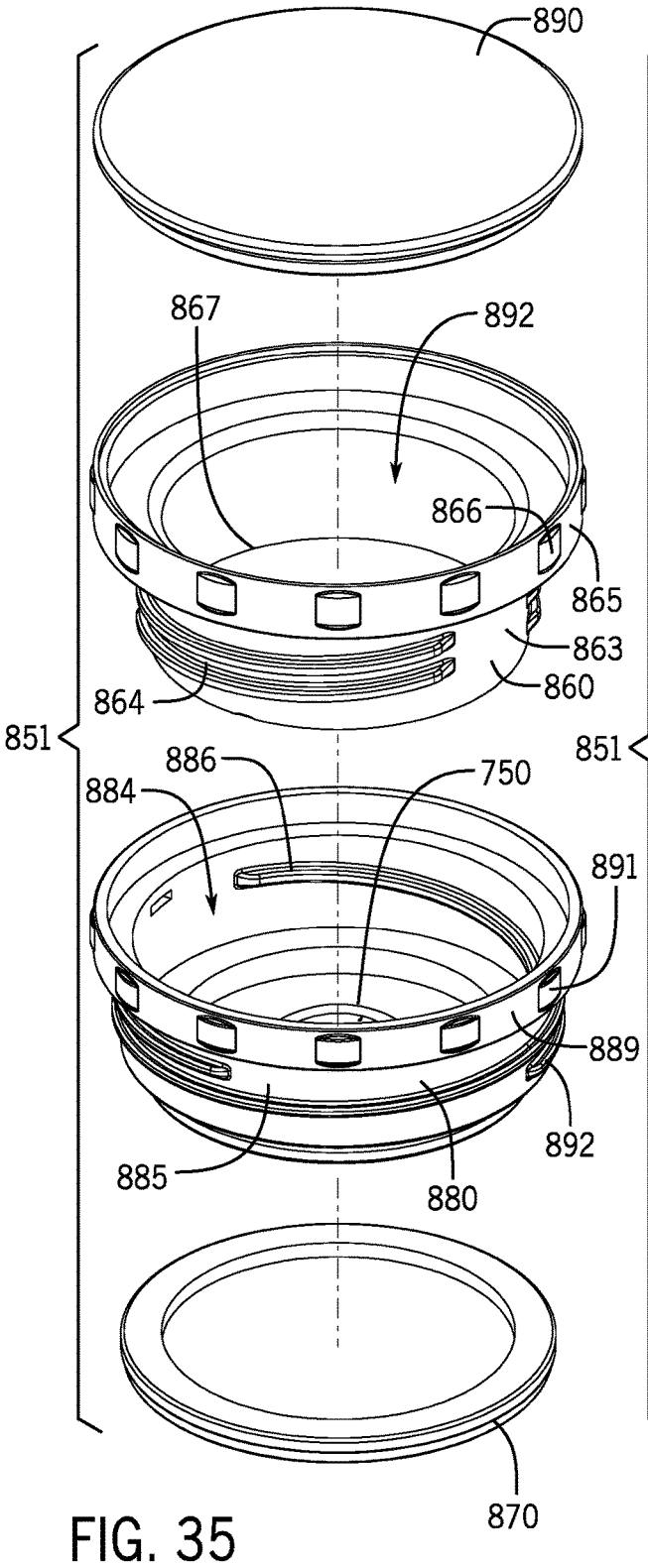
FIG. 35 is an exploded view of an embodiment of the fourth stopper.

The gasket 750 is positioned at or in the vent passage 744. In a normal position with relatively equal pressures in the container 401 and in the ambient environment, the flap 763 seals against the closing member 714 to close the vent passage 744. When the pressure in the container 401 elevates to a high pressure condition, as shown in FIG. 32, the flap 763 will deflect outward or upward, thus widening the gasket opening 752, to release pressure from within the container 401. The pressure may pass between the deflecting flap 763 and an outer surface 717 of the closing member 714. The gasket 750 may also provide an automatic release of pressure without having to unscrew the upper stopper 710 or otherwise move upper stopper 710. As such, the gasket 750 may act as an automatic pressure relief valve for the container 401. In the normal position as shown in FIG. 31, the flap 763 extends generally inward against the outer surface 717 of the closing member 714. In a low pressure condition within the container 401, as shown in FIG. 33, the flap 763 deflects downward or inward—away from the outer surface 717 of the closing member 714 to allow ambient air to enter the container 401. The materials, shape, and size of the gasket 750, its flap 763, and the closing member 714 may be adjusted to provide for the flap 763 to deflect at varying levels of high or low pressure within the container 401.

The gasket 750 may be formed from an elastomeric or resilient material. The gasket 750 may include a circular exterior channel 753 that receives edges 747 of the vent passage 744. The edges 747 are formed in the lower surface of the lower stopper 740. The shapes and position of the exterior channel 753 and the edges 747 of the vent passage 744 are configured to facilitate holding the gasket 750 in the desired position relative to the vent passage 744.

The upper stopper 710 may include a stopper top 770 configured to hold or receive an eating utensil 771, such as a fork, spoon, etc. Condiments, drink additives, crackers, seasonings, and other food products may also be stored in between the stopper top 770 and the lid 601 or in the interior of the upper stopper 710.

With reference to FIGS. 34-37, a stopper 851 is shown. The stopper 851 may be sized and shaped to operate with the container 401 or other containers to form food jars or beverage containers. The stopper 851 may operate with or without a lid. The stopper 851 includes an upper stopper 860 and a lower stopper 880. The stopper 851 operates similarly to the stopper 700, except the stopper 851 does not include the projecting members 720 or the flexible catches 760 of the stopper 700. As described below, the lower stopper 880 may screw to the container 401, and the upper stopper 860 screws into the lower stopper 880.

The lower stopper 880 includes a threaded external surface 892 to threadably engage with the threaded internal surface 415 of the neck 411 of the container 401. As the stopper 851 is threadably engaged to the container 401, a lower stopper seal 870 of the lower stopper 880 is urged or pressed against the internal surface 417 of the neck 411 or the container 401 to seal the container 401 to a closed position. The lower stopper seal 870 may be positioned on a lower, outer diameter of the lower stopper 880.

The lower stopper 880 includes a vent passage 883 that provides for gas/air to pass to or from the container 401. The upper stopper 860 includes a lower surface 861 that includes or forms a closing member 862 that interacts with the vent passage 883 of the lower stopper 880. The closing member 862 is on the underside of upper stopper 860. The closing member 862 is inserted into the vent passage 883 as the upper stopper 860 is screwed into the lower stopper 880, which closes the vent passage 883. The closing member 862 is removed from the vent passage 883 as the upper stopper 860 is unscrewed from the lower stopper 880 to open the vent passage 883. This allows interior pressure within the container 401 to equalize with ambient pressure.

The upper stopper 860 threadably fits into an interior 884 of the lower stopper 880. The upper stopper 860 includes a sidewall 863 with a threaded external surface 864. The lower stopper 880 includes a sidewall 885 with a threaded internal surface 886. When the upper stopper 860 is screwed to the lower stopper 880, the threaded external surface 864 of the exterior of the upper stopper 860 threadably engages with the threaded internal surface 886 of the interior of the lower stopper 880. The upper stopper 860 further includes an upper rim 865 with gripping surfaces 866 for the user to grip onto while rotating the upper stopper 860. The lower stopper 880 further includes an upper rim 889 with gripping surfaces 891 for the user to grip onto while rotating the upper stopper 880.

In operation, the user may partially unscrew the upper stopper 860 from the lower stopper 880 and thus withdraw the closing member 862 from the vent passage 883 to relieve high and lower pressures before unscrewing the lower stopper 880. This reduces a risk of the contents of the container 401 exhausting from the container 401 under pressure. Also, in a low pressure situation, partially unscrewing the upper stopper 860 from the lower stopper 880 is physically easier than just unscrewing lower stopper 860. Or, the user may choose to only unscrew the lower stopper 880 from the container 401 without unscrewing the upper stopper 860 from the lower stopper 880. Or, the user may choose to first remove the upper stopper 860 from the lower stopper 880 and then remove the lower stopper 880 from the container 401. The upper stopper 860 may be completely separated from the lower stopper 880 for cleaning.

The vent passage 883 includes the gasket 750 with the gasket opening 752 described with reference to FIGS. 23-33. As the upper stopper 860 is unscrewed in a low pressure situation within the container 401, ambient air may pass through the vent passage 883 and into the interior of the container 401. In a high pressure situation within the container 401, air or gas in the interior may exit the container 401 through the vent passage 883.

Figure 36:
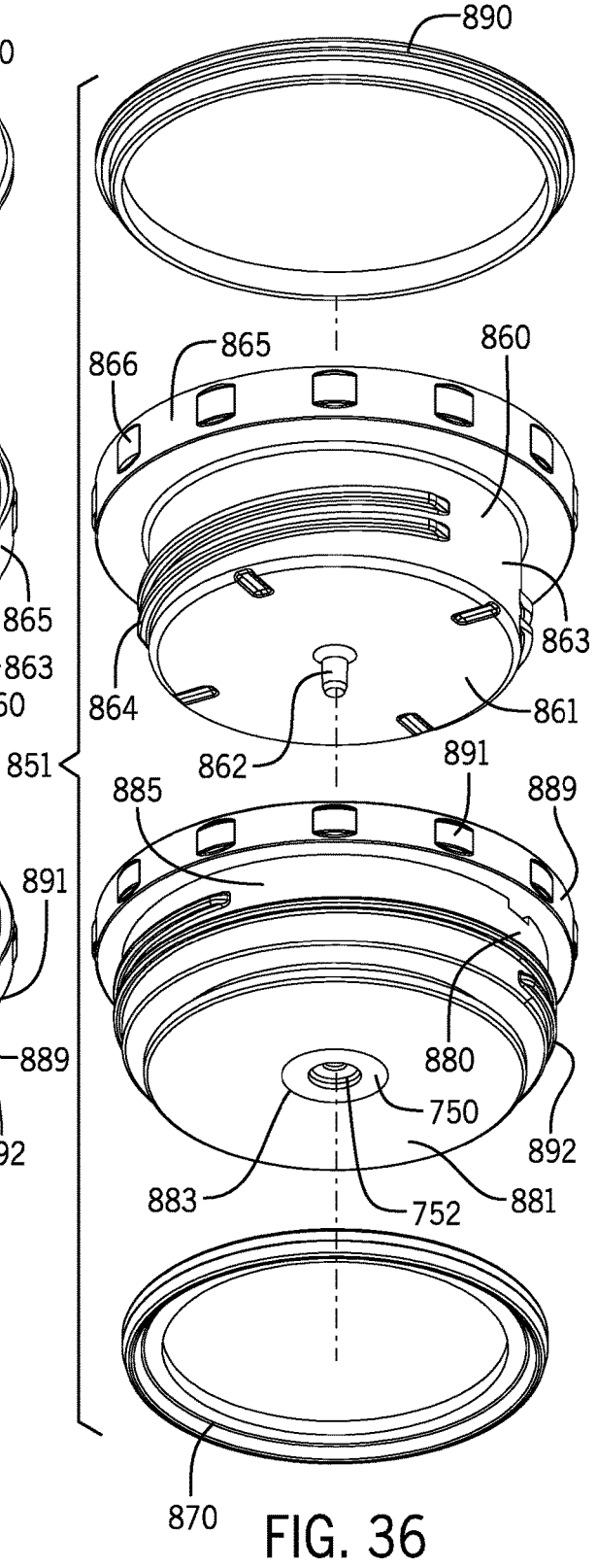
FIG. 36 is an exploded view of an embodiment of the fourth stopper.
Figure 38:
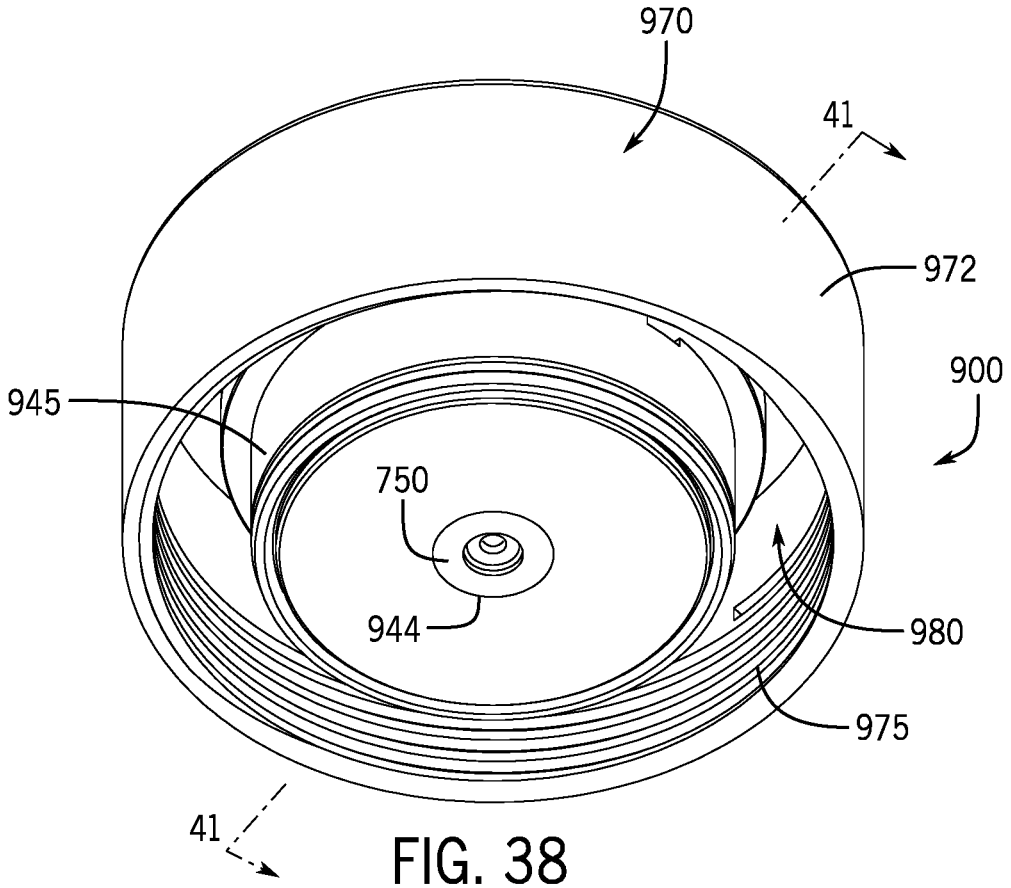
FIG. 38 is a perspective view of an embodiment of a fifth stopper.
Figure 41:
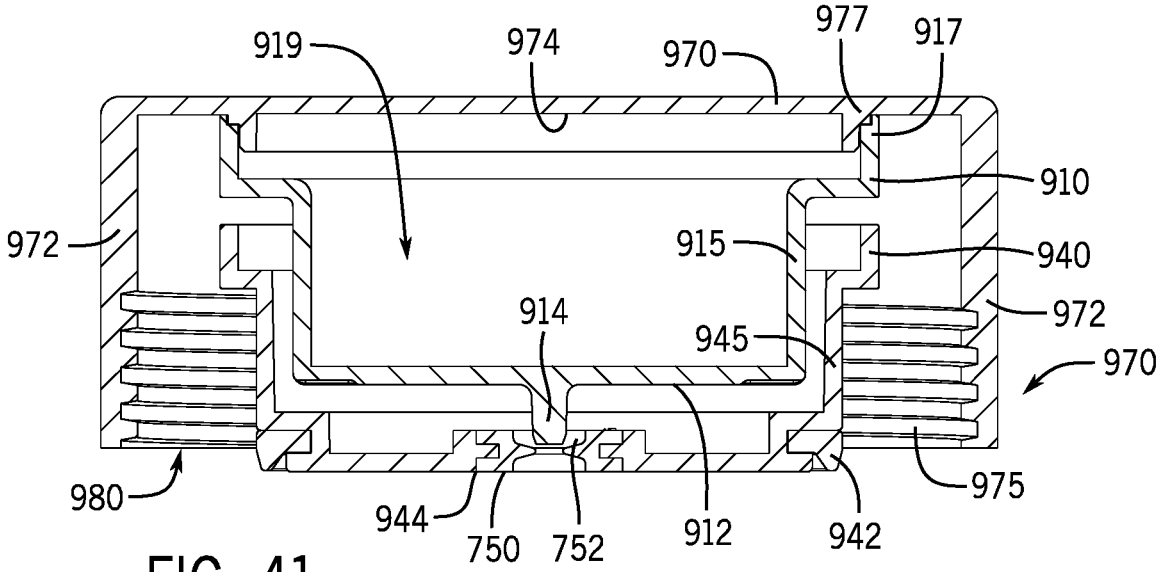
FIG. 41 is a sectional view of an embodiment of the fifth stopper.
Figure 39:
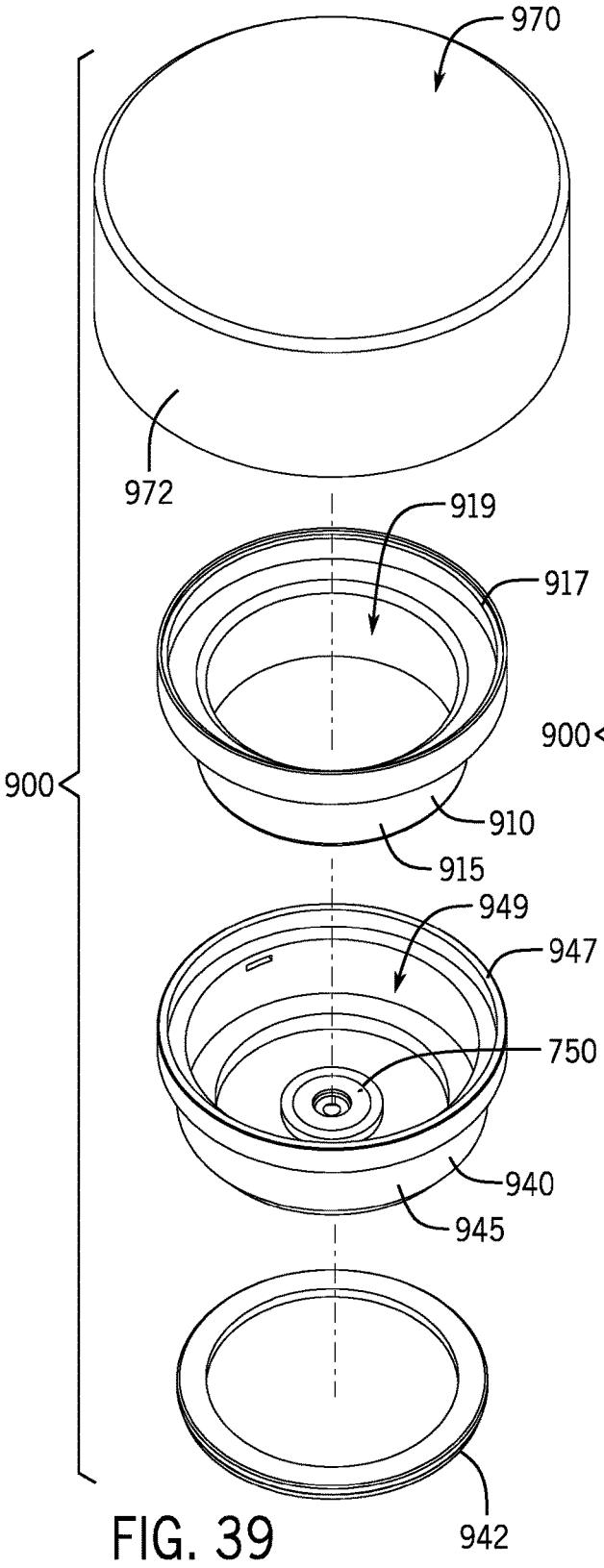
FIG. 39 is an exploded view of an embodiment of the fifth stopper.

With respect to FIG. 36, the lower surface 861 of the upper stopper 860 is shown. The closing member 862 extends or projects from the lower surface 861. This provides for the closing member 862 to enter the gasket opening 752 and close the vent passage 883 as the stopper 851 is screwed to the container 401. As the stopper 851 is screwed to the container 401, the closing member 862 moves closer to the gasket opening 752, and, as the stopper 851 is further screwed to the container 401, the closing member 862 enters or inserts into the gasket opening 752. When the threaded surfaces are fully tightened, the closing member 862 is fully inserted into the gasket opening 752 and closes the gasket 750.

The closing member 862 may be centrally located on the lower surface 861. A central axis of the closing member 862 is aligned with a central axis of the vent passage 883. The lower surface 861 of the lower stopper 860 may be generally flat. The closing member 862 extends or projects from the lower surface 861 of the lower stopper 860.

The vent passage 883 of the stopper 851 releases pressure from within the container 401 before the stopper 851 is fully twisted off of the container 401. When the stopper 851 is at least partially unscrewed, the vent passage 883 is opened to vent the interior of the container 401 in a controlled manner. This is advantageous since there is a possibility that pressure may build up in the interior of the container 401 when the container 401 has been agitated or the food has been stored in the container 401 for too long. The partial unscrewing of the stopper 851 may open the vent passage 883 of the stopper 851 to release a vacuum that has formed within the container 401 when the food item has cooled in the food jar 13. This provides for easier removal of the stopper 851. The vent passage 883 is able to relieve pressure within the container 401 without totally removing the lid 601, which helps reduce inadvertent food spray when the high pressure within the container 401 is relieved.

The closing member 862 may include other closing members, descending members, plugs, stoppers, extensions, etc. positioned or formed on or of the upper stopper 860 that inserts into, seals, blocks, or otherwise closes a vent of the lower stopper 880. The screwing of the upper stopper 860 to the lower stopper 880 aligns the closing member 862 with the gasket opening 752 of the vent passage 883.

The gasket 750 is also designed to release pressure from the container 401 and allow ambient air to enter the container 401 to relieve a vacuum condition in the container 401 without having to unscrew the stopper 851 from the container 401.

The gasket 750 may include the circular exterior channel 753 that receives edges 887 of the vent passage 883. The edges 887 are formed in the lower surface 881 of the lower stopper 880. The gasket 750 may also be used with the stoppers 200 and 500 described herein.

The upper stopper 860 may include a stopper top 890 configured to define a storage region 892 to hold or contain eating utensil, such as a fork, spoon, etc. or food items such as, condiments, drink additives, crackers, seasonings, and other food products. The storage region 892 may formed between the stopper top 890 and an upper surface 867 of the upper stopper 860. The upper surface 867 may form a concave or a receptacle shape to receive eating utensil, food items, etc. The stopper top 890 may snap-fit to the upper stopper 860.

With reference to FIGS. 38-42, a stopper 900 is shown. The stopper 900 may be sized and shaped to operate with a container 950 or other containers to form a food jar 14 or other food jars and beverage containers. The stopper 900 includes an upper stopper 910 and a lower stopper 940. The stopper 900 further includes a lid 970. As described below, the lid 970 may screw to the container 950 and urge the stopper 900 in a sealing engagement with the container 950.

The lid 970 includes a sidewall 972 with a threaded internal surface 975 to threadably engage with a threaded external surface 955 of a neck 957 of the container 950. The lower stopper 940 may be placed over or into the opening of the container 950. The lid 970 and the upper stopper 910 are placed over the lower stopper 940. As the lid 970 900 is threadably engaged to the container 950, the upper stopper 910 presses against the lower stopper 940. A lower stopper seal 942 of the lower stopper 940 is urged or pressed against an internal surface of the neck 957 or the container 950 to seal the container 950 to a closed position. The lower stopper seal 942 may be positioned on a lower, outer diameter of the lower stopper 940.

In the aspect shown, the upper stopper 910 is engaged to a lower surface 974 of the lid 970, and the screwing of the lid 970 to the container 950 drives the upper stopper 910 into the lower stopper 940. The lid 970 and the upper stopper 910 may be completely separable from the lower stopper 940.

The lower stopper 940 includes a vent passage 944 that provides for gas/air to pass to or from the container 950. The upper stopper 910 includes a lower surface 912 that includes or forms a closing member 914 that interacts with the vent passage 944 of the lower stopper 940. The closing member 914 is on the underside of upper stopper 910. The closing member 914 is inserted into the vent passage 944 as the upper stopper 910 is urged into the lower stopper 940, which closes the vent passage 944. The closing member 914 is removed from the vent passage 944 as the upper stopper 910 is removed from the lower stopper 940 to open the vent passage 944. This allows interior pressure within the container 950 to equalize with ambient pressure.

The upper stopper 910 nests or inserts into an interior 949 of the lower stopper 940. The upper stopper 910 includes a sidewall 915. The lower stopper 940 includes a sidewall 945. When the upper stopper 910 is engaged to the lower stopper 940, the closing member 914 is aligned with the vent passage 944 of the lower stopper 940, and the sidewall 915 of the upper stopper 910 is generally parallel to the sidewall 945 of the lower stopper 940. The sidewall 915 of the upper stopper 910 has a diameter generally smaller than the sidewall 945 of the lower stopper 940.

A combination of the sidewall 972 of the lid 970 and the sidewall 945 of the lower stopper 940 form a channel 980 that receives the neck 957 of the container 950. When the stopper 900 is fully secured to the container 950, the lower stopper 940 generally enters an opening of the container 950.

In the aspect shown, the upper stopper 910 is engaged to the lower surface 974 of the lid 970. With respect to FIG. 41, a flange 977 extends from the lower surface 974 and attaches or engages to an upper rim 917 of the upper stopper 910. The lower surface 974 may be in permanent or removable engagement with the upper stopper 910. The rotation of the lid 970 drives or rotates the upper stopper 910. In some aspects, the lid 970 may be removable to access a storage area 919 in the upper stopper 910 to hold or contain eating utensil, such as a fork, spoon, etc. or food items such as, drink additives, condiments, crackers, seasonings, and other food products In operation, the user may unscrew the lid 970 from the container 950 to withdraw the upper stopper 910 from the lower stopper 940 and thus withdraw the closing member 914 from the vent passage 944 to relive high and lower pressures in the container 950. This reduces a risk of the contents of the container 950 exhausting from the container 950 under pressure.

The vent passage 944 includes the gasket 750 with the gasket opening 752 described with reference to FIGS. 23-33. As the upper stopper 910 is unscrewed in a low pressure situation within the container 950, ambient air external to the container 950 may pass through the vent passage 944 and into the interior of the container 950. In a high pressure situation within the container 950, air or gas in the interior of the container 950 may exit the container 950 through the vent passage 944.

Figure 40:
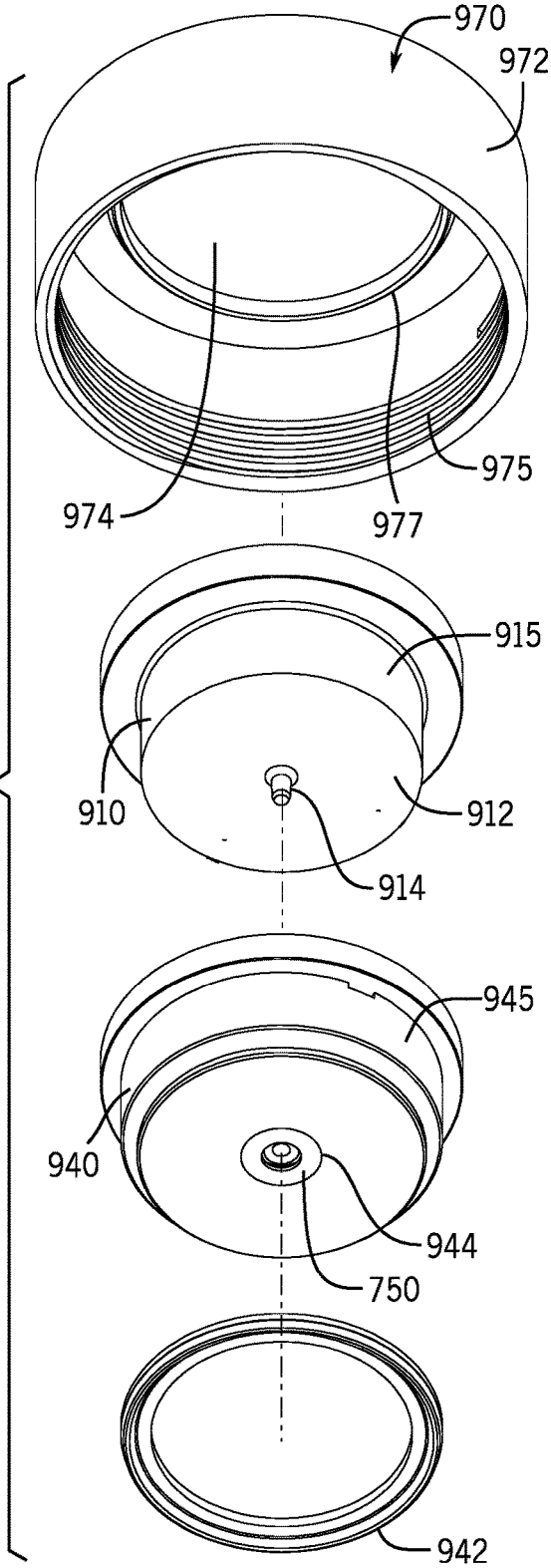
FIG. 40 is an exploded view of an embodiment of the fifth stopper.
Figure 42:
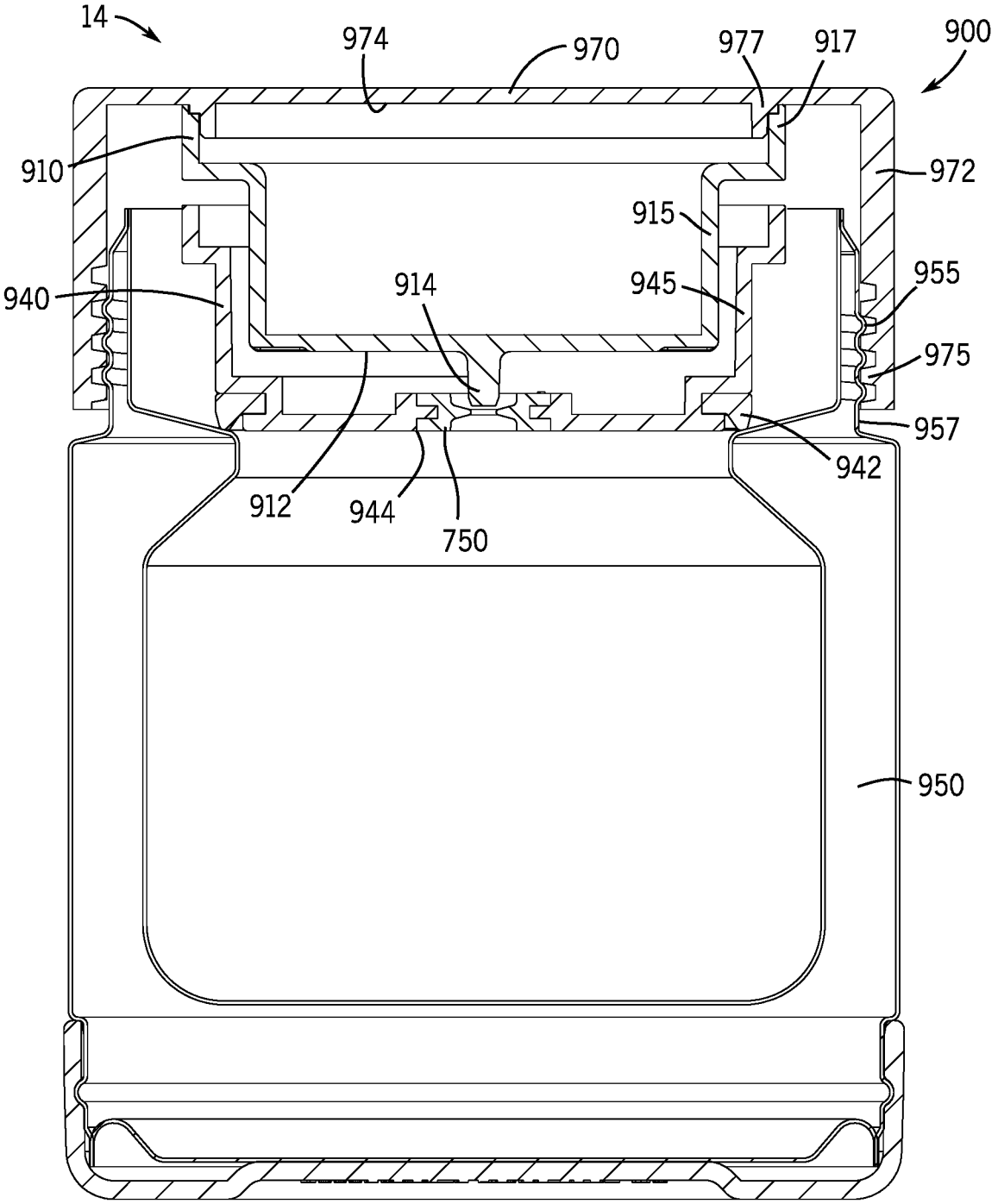
FIG. 42 is a sectional view of an embodiment of a fourth food jar used with the fifth stopper.

With respect to FIG. 40, the lower surface 912 of the upper stopper 910 is shown. The closing member 914 extends or projects from the lower surface 912. This provides for the closing member 914 to enter the gasket opening 752 and close the vent passage 944 as the stopper 900 is screwed to the container 950. As the stopper 900 is screwed to the container 950, the closing member 914 moves closer to the gasket opening 752, and, as the stopper 900 is further screwed to the container 950, the closing member 914 enters or inserts into the gasket opening 752. When the threaded surfaces are fully tightened, the closing member 914 is fully inserted into the gasket opening 752 and closes the gasket 750.

The closing member 914 may be centrally located on the lower surface 912. A central axis of the closing member 914 is aligned with a central axis of the vent passage 944. The lower surface 912 of the lower stopper 910 may be generally flat. The closing member 914 extends or projects from the lower surface 912 of the lower stopper 910.

The vent passage 944 of the stopper 900 releases pressure from within the container 950 before the lid 970 is fully twisted off of the container 950. When the lid 970 is at least partially unscrewed, the vent passage 944 is opened to vent the interior of the container 950 in a controlled manner. This is advantageous since there is a possibility that pressure may build up in the interior of the container 950 when the container 950 has been agitated or the food has been stored in the container 950 for too long. The partial unscrewing of the lid 970 may open the vent passage 944 of the stopper 900 to releases a vacuum that has formed within the container 950 when the food item has cooled in the container 950. This provides for easier removal of the stopper 900. The vent passage 944 is able to relieve pressure within the container 950 without totally removing the lid 970, which helps reduce inadvertent food spray when the high pressure within the container 950 is relieved.

The closing member 914 may include other closing members, descending members, plugs, stoppers, extensions, etc. positioned or formed on or of the upper stopper 910 that inserts into, seals, blocks, or otherwise closes a vent of the lower stopper 940. The screwing of the upper stopper 910 to the container 950 aligns the closing member 914 with the gasket opening 752 of the vent passage 944.

As described with respect to other aspects herein, the gasket 750 is also designed to release pressure from the container 950 and allow ambient air to enter the container 950 to relieve a vacuum condition in the container 950 without having to unscrew the lid 970 from the container 950.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A food jar, comprising:

a container, the container defining an interior to store a food product, the container having an opening;

an upper stopper, a lower surface of the upper stopper forming a closing member;

a lower stopper, the lower stopper configured to close the opening of the container, the lower stopper including a vent passage, the lower stopper including a gasket positioned at the vent passage, the gasket including a gasket opening and a flap;

the lower stopper configured to receive the upper stopper into an interior of the lower stopper such that the closing member of the upper stopper inserts into the gasket opening of the lower stopper and the flap contacts the closing member to close the vent passage when the upper stopper and the lower stopper are in a generally closed position;

wherein the flap is movable in one direction to release gas from the container, and the flap is movable in another direction to admit ambient air into the container; and, wherein the upper stopper includes a sidewall having one or more projecting members that extend outward from the sidewall, wherein the lower stopper includes one or more flexible catches formed in a rim of a sidewall of the lower stopper, the flexible catches extend inward towards a center of the lower stopper, and the projecting members engage the flexible catches and drive the lower stopper and the closing member when the upper stopper is rotated in an unscrewing direction.

2. The food jar according to claim 1, wherein, in the closed position, the flap is configured to automatically deflect in one direction to release gas from the container, and the flap is configured to automatically deflect in another direction to admit ambient air into the container.

3. The food jar according to claim 1, wherein the projecting members are configured on the sidewall of the upper stopper to provide for the upper stopper to unscrew sufficiently to withdraw the closing member from the vent passage before the projecting members engage the flexible catches to drive lower stopper in the unscrewing direction.

4. The food jar according to claim 1, further comprising a lid, the upper stopper is engaged to a lower surface of the lid, and the screwing of the lid to the container in a tightening direction drives the upper stopper into the lower stopper and the closing member toward the vent passage.

5. The food jar according to claim 4, wherein the lid includes a sidewall with a threaded internal surface to threadably engage with a threaded external surface of a neck of the container, and the sidewall of the lid and a sidewall of the lower stopper form a channel that receives a neck of the container.

6. The food jar according to claim 1, wherein the closing member extends or projects from the lower surface of the upper stopper, and the closing member includes a peg.

7. The food jar according to claim 1, wherein the closing member is formed on a lower surface of the upper stopper and is sized to enter the gasket opening.

8. The food jar according to claim 1, wherein the upper stopper nests or inserts into the interior of the lower stopper.

9. The food jar according to claim 1, wherein the upper stopper includes a sidewall with a threaded external surface, the lower stopper includes a sidewall with a threaded internal surface, and the threaded external surface of the upper stopper threadably engages with the threaded internal surface of the lower stopper.

10. The food jar according to claim 9, wherein the closing member withdraws from the gasket opening when the upper stopper is partially, but not completely, unthreaded from the lower stopper.

11. The food jar according to claim 9, wherein threading the upper stopper to the lower stopper aligns the closing member with the gasket opening.

12. The food jar according to claim 9, wherein the vent passage is closed when the upper stopper is fully threaded to the lower stopper and the ent passage is opened when the upper stopper is at least partially unthreaded from the lower stopper.

13. The food jar according to claim 1, wherein the vent passage is integrally molded in the lower stopper, wherein the lower stopper forms a cup-like structure with the vent passage in a center of the lower stopper.

14. The food jar according to claim 1, wherein the one or more flexible catches are formed by relief cuts in the sidewall.

15. The food jar according to claim 1, wherein the projecting members are configured to contact an interior surface of the flexible catches and deflect the flexible catches outward when the upper stopper is rotated in a tightening direction with respect to the lower stopper.

16. The food jar according to claim 1, wherein the ent passage of the stopper is configured to release pressure from within the container before the stopper is fully removed from the container.

17. A food jar, comprising: a container, the container defining an interior to store a food product, the container having an opening; an upper stopper, a lower surface of the upper stopper having a closing member; a lower stopper, the lower stopper configured to close the opening of the container, the lower stopper including a vent passage, the lower stopper including a gasket positioned at the vent passage, the gasket including a gasket opening and a flap; the lower stopper configured to receive the upper stopper into an interior of the lower stopper such that the closing member of the upper stopper inserts into the gasket opening of the lower stopper and the flap contacts the closing member to close the vent passage when the upper stopper and the lower stopper are in a generally closed position; and, wherein, in the generally closed position, the flap is configured to automatically deflect in one direction to release gas from the container, and the flap is further configured to automatically deflect in another direction to admit ambient air into the container.

18. The food jar according to claim 17, wherein the upper stopper includes a sidewall with a threaded external surface, the lower stopper includes a sidewall with a threaded internal surface, and the threaded external surface of the upper stopper threadably engages with the threaded internal surface of the lower stopper.

19. The food jar according to claim 17, wherein the gasket includes a circular exterior channel that receives edges of the vent passage.

20. A stopper for a food jar container, comprising: a container, the container defining an interior to store a food product, the container having an opening; an upper stopper, a lower surface of the upper stopper having a closing member; a lower stopper, the lower stopper configured to close the an opening of the food container, the lower stopper including a vent passage, the lower stopper including a gasket positioned at the vent passage, the gasket including a gasket opening and a flap; the lower stopper configured to receive the upper stopper into an interior of the lower stopper such that the closing member of the upper stopper inserts into the gasket opening of the lower stopper and the flap contacts the closing member to close the ent passage when the upper stopper and the lower stopper m in a generally closed position; and, wherein the flap is movable in one direction to release gas from the container, and the flap is movable in another direction to admit ambient air into the container; wherein the upper stopper includes a sidewall having one or more projecting members that extend outward from the sidewall, wherein the lower stopper include one or more flexible catches formed in an upper rim of a sidewall of the lower stopper, the flexible catches extend inward towards a center of the lower stopper, and the projecting members engage the flexible catches and drive the lower stopper when the upper stopper is rotated in an unscrewing direction; and, wherein the projecting members are configured on the sidewall of the upper stopper to provide for the upper stopper to unscrew sufficiently to withdraw the closing member from the vent passage before the projecting members engage the flexible catches to drive lower stopper in the unscrewing direction.

* * * * *